US009921013B1

(12) United States Patent
Oglesby

(10) Patent No.: US 9,921,013 B1
(45) Date of Patent: Mar. 20, 2018

(54) ADJUSTABLE BUFFER SYSTEM

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 15/389,468

(22) Filed: Dec. 23, 2016

Related U.S. Application Data

(63) Continuation-in-part of application No. 15/379,045, filed on Dec. 14, 2016.

(60) Provisional application No. 62/269,962, filed on Dec. 19, 2015.

(51) Int. Cl.
*F41A 3/80* (2006.01)

(52) U.S. Cl.
CPC ..... *F41A 3/80* (2013.01)

(58) Field of Classification Search
CPC ..... F41A 25/00; F41A 25/10; F41A 25/12; F41A 25/14; F41A 25/16; F41A 3/78; F41A 3/80; F41A 3/82; F41A 3/84; F41C 23/06
See application file for complete search history.

(56) References Cited

U.S. PATENT DOCUMENTS 5,909,002 A * 6/1999 Atchisson ..... F41A 3/84 42/1.06
6,829,974 B1 * 12/2004 Gwinn, Jr. ..... F41A 3/70 89/130
7,131,367 B1 * 11/2006 Boerschig ..... F41A 3/70 42/1.06
8,991,088 B1 * 3/2015 Young ..... F41A 25/00 42/75.03
9,080,823 B1 * 7/2015 Mantas ..... F41A 25/12
9,267,747 B2 * 2/2016 Caudle ..... F41A 3/84
9,395,148 B1 * 7/2016 Huang ..... F41C 23/06
9,625,232 B2 * 4/2017 Gomez ..... F41C 23/06
2013/0319217 A1 * 12/2013 Gangl ..... F41A 3/84 89/198
2014/0075798 A1 * 3/2014 Kincel ..... F41A 3/84 42/1.06
2014/0224112 A1 * 8/2014 Verry ..... F41A 19/03 89/130
2014/0260946 A1 * 9/2014 Gomez ..... F41A 5/18 89/191.01
2015/0345895 A1 * 12/2015 Young ..... F41A 11/04 42/71.01
2017/0067716 A1 * 3/2017 Huang ..... F41C 23/06

* cited by examiner

*Primary Examiner* — Benjamin P Lee
(74) *Attorney, Agent, or Firm* — Shaddock Law Group, PC

(57) ABSTRACT

An adjustable buffer system, including at least some of a buffer, wherein the buffer element includes a collar cavity and a spacer cavity, wherein a bolt aperture is formed between the collar cavity and the spacer cavity, and wherein two or more longitudinally extending slots are formed in at least a portion of the buffer element; an adjustment bolt, wherein the adjustment bolt comprises an externally threaded body portion; a slidable collar than includes a ring portion surrounding a core portion and spaced apart by two or more legs, and wherein prong apertures are defined between the ring portion, the core portion, and the legs, wherein each of the legs corresponds to a longitudinally extending slot, such that the slidable collar is repeatably slidable along at least a portion of the buffer element as rotational force is applied to the adjustment bolt.

20 Claims, 18 Drawing Sheets

ADJUSTABLE BUFFER SYSTEM

CROSS-REFERENCE TO RELATED APPLICATIONS

This patent application is a Continuation-In-Part of co-pending U.S. patent application Ser. No. 15/379,045, filed Dec. 14, 2016, which claims the benefit of U.S. Patent Application Ser. No. 62/269,962, filed Dec. 19, 2015, the disclosures of which are incorporated herein by reference in their entireties.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an adjustable buffer system for a firearm.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a fixed or variable position buttstock. Typically, the variable position buttstock is slidable and lockable at various positions along a buffer tube.

The typical buffer tube includes a capped cylindrical portion having a threaded portion for installation into a buffer tube receiving aperture of a lower receiver. Typically, an end plate and a castle collar nut are utilized to complete installation of the buffer tube on the receiver.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier and the bolt and drives the bolt carrier rearward.

The buffer, which is pushing on the rear of the bolt carrier group, is forced rearward by the bolt carrier group, compressing the buffer spring. During this rearward movement, a cam track in the upper portion of the bolt carrier acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the bottom wall at the rear of the buffer tube), the compressed buffer spring expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, the typical buffer does not allow the user to adjust the preload or tension of the buffer spring.

The disadvantages and shortcomings of the prior art are overcome by the features and elements of the adjustable buffer system of the present disclosure. The advantages of the present disclosure are preferably attained by providing, in an exemplary, nonlimiting embodiment, an adjustable buffer system that includes a slidable collar that can be moved up and down the shaft or buffer body of the buffer element. The collar works against either a modified or a standard buffer spring. If utilized with a modified buffer spring, the modified buffer spring does not compress to solid height at the same length as a standard buffer. By not compressing to the solid height, if or when the adjustable buffer system has reached its maximum length of travel in the buffer tube, the buffer spring is still not fully compressed.

By adjusting the position of the slidable collar along the buffer body, the buffer spring can be forced to compress further. This effect increases spring pressure on the buffer element and softens the recoil action of the firearm.

In various exemplary embodiments, sufficient adjustment of slidable collar is provided to allow the buffer element to be used in various barrel length rifles with different gas tube lengths and gas port diameters.

In certain exemplary, nonlimiting embodiments of the present disclosure, the adjustable buffer system optionally includes at least some of a buffer element, wherein the buffer element includes a collar cavity, wherein the collar cavity extends from a first end of the buffer element, along one or more collar cavity interior side walls, to a collar cavity bottom wall, wherein the buffer element includes a spacer cavity, wherein the spacer cavity extends from a second end of the buffer element, along one or more buffer cavity interior side walls, to a buffer cavity bottom wall, wherein a bolt aperture is formed between the collar cavity bottom wall and the spacer cavity bottom wall, wherein an externally threaded portion extends from the first end of the buffer element, wherein an internally threaded buffer screw aperture is formed in the buffer element, proximate the first end of the buffer element, wherein two or more longitudinally extending slots are formed in at least a portion of the buffer element, extending from the first end of the buffer element, and wherein a prong is defined between each longitudinally extending slot; a set screw, wherein the set screw includes an internal recess that includes a captured, spring biased detent; a collar nut, wherein the collar nut includes an internally threaded collar nut aperture formed through the collar nut, wherein the internally threaded portion includes threads that correspond to the externally threaded portion of the buffer element, such that the collar nut may be threadedly attached to the buffer element, via interaction of the externally threaded portion of the buffer element and the internally threaded portion of the collar nut, and wherein an internally threaded collar screw aperture is formed the collar nut so as to be aligned with the internally threaded buffer screw aperture, when the collar nut is appropriately, threadedly attached to the buffer element, and wherein when the internally threaded collar screw aperture is aligned with the internally threaded buffer screw aperture, the set screw may be threadedly inserted within at least a portion of the internally threaded collar screw aperture and the aligned internally threaded buffer screw aperture; an adjustment bolt, wherein the adjustment bolt comprises a head portion and an externally threaded body portion extending from the head portion, wherein a capture pin recess is formed in a terminal end of the adjustment bolt, wherein the capture pin recess is formed so as to accept at least a portion of a capture pin within the capture pin recess, and wherein one or more recesses are formed around the outer circumference of the head portion; a slidable collar, wherein the slidable collar includes a ring portion, wherein the ring portion surrounds a core portion, wherein the ring portion is spaced apart from the core portion by two or more legs, and wherein prong apertures are defined between the ring portion, the core portion, and the legs, wherein each of the legs corresponds to a longitudinally extending slot, wherein each prong aperture is formed so as to allow a portion of a prong to be fitted therethrough, such that the slidable collar is repeatably slidable along at least a portion of the buffer element, wherein an internally threaded collar aperture is formed through the core portion, wherein the internally threaded collar aperture includes threads that correspond to the externally threaded body portion of the adjustment bolt, and wherein the slidable collar may be threadedly attached to at least a portion of the adjustment bolt, via interaction of the externally threaded body portion of the adjustment bolt and the internally threaded collar aperture of the slidable collar, such that rotational movement of the adjustment bolt relative to the buffer element produces longitudinal movement of the slidable collar along the buffer element; a buffer spacer, wherein the buffer spacer includes an internally threaded buffer spacer aperture formed through the buffer spacer, wherein the internally threaded buffer spacer aperture includes threads that correspond to the externally threaded body portion of the adjustment bolt, such that the buffer spacer may be threadedly attached to the adjustment bolt, via interaction of the externally threaded body portion of the adjustment bolt and the internally threaded buffer spacer aperture of the buffer spacer, wherein a capture pin recess is formed in a terminal end of the adjustment bolt, and wherein the capture pin recess is formed so as to accept at least a portion of the capture pin within the capture pin recess; and an end cap, wherein an extension portion of the end cap may be abutted against the capture pin to assist in maintaining the capture pin within at least portions of the capture pin recess of the buffer spacer and the capture pin recess of the adjustment bolt.

In certain exemplary, nonlimiting embodiments of the present disclosure, the buffer screw aperture is formed through the buffer element within a portion of the externally threaded portion of the buffer element.

In certain exemplary, nonlimiting embodiments of the present disclosure, a spring or other spring biasing element, within the internal recess of the set screw, supplies a spring biasing force to the detent.

In certain exemplary, nonlimiting embodiments of the present disclosure, the longitudinally extending slots extend from the first end of the buffer element to the collar cavity bottom wall.

In certain exemplary, nonlimiting embodiments of the present disclosure, the adjustable buffer system further and optionally includes three or more longitudinally extending slots formed in at least a portion of the buffer element, extending from the first end of the buffer element, wherein a prong is defined between each longitudinally extending slot.

In certain exemplary, nonlimiting embodiments of the present disclosure, the adjustable buffer system further and optionally includes one or more notches formed around portions of the collar nut.

In certain exemplary, nonlimiting embodiments of the present disclosure, the adjustable buffer system further and optionally includes a series of recesses formed around the outer circumference of the head portion.

In certain exemplary, nonlimiting embodiments of the present disclosure, the adjustable buffer system further and optionally includes a slot formed in the head portion, wherein the slot allows rotational force to be applied to the adjustment bolt.

In certain exemplary, nonlimiting embodiments of the present disclosure, the core portion may be slidably fitted within at least a portion of the collar cavity, with each leg being slidably fitted within a longitudinally extending slot.

In certain exemplary, nonlimiting embodiments of the present disclosure, the legs are formed so as to be aligned with and slidable along the longitudinally extending slots of the buffer element, such that interaction of the legs and the longitudinally extending slots maintains the slidable collar in a substantially consistent rotational position relative to the buffer element.

In certain exemplary, nonlimiting embodiments of the present disclosure, one or more notches are formed around portions of the slidable collar.

In certain exemplary, nonlimiting embodiments of the present disclosure, when the buffer spacer is appropriately, threadedly attached to the adjustment bolt, the attachment bolt extends through the buffer spacer such that the capture pin recess of the buffer spacer is aligned with the capture pin recess of the adjustment bolt and the capture pin is positioned within at least portions of the aligned capture pin recess of the buffer spacer and the capture pin recess of the adjustment such that the attachment bolt is maintained in a fixed, rotational position relative to the buffer spacer.

In certain exemplary, nonlimiting embodiments of the present disclosure, the set screw is threadedly inserted within at least a portion of the internally threaded collar screw aperture and the aligned internally threaded buffer screw aperture, at least a portion of the detent extends into the collar cavity a sufficient distance to interact with and be at least partially captured within a portion of a recess of the adjustment bolt.

In certain exemplary, nonlimiting embodiments of the present disclosure, the adjustable buffer system optionally includes at least some of a buffer element, wherein the buffer element includes a collar cavity, wherein the collar cavity extends from a first end of the buffer element, along one or more collar cavity interior side walls, to a collar cavity bottom wall, wherein the buffer element includes a spacer cavity, wherein the spacer cavity extends from a second end of the buffer element, along one or more buffer cavity interior side walls, to a buffer cavity bottom wall, wherein a bolt aperture is formed between the collar cavity bottom wall and the spacer cavity bottom wall, wherein an externally threaded portion extends from the first end of the buffer element, wherein an internally threaded buffer screw aperture is formed in the buffer element, proximate the first end of the buffer element, wherein two or more longitudinally extending slots are formed in at least a portion of the buffer element, extending from the first end of the buffer element, and wherein a prong is defined between each longitudinally extending slot; a set screw, wherein the set screw includes an internal recess that includes a captured, spring biased detent; a collar nut, wherein the collar nut includes an internally threaded collar nut aperture formed through the collar nut, wherein the internally threaded portion includes threads that correspond to the externally threaded portion of the buffer element, such that the collar nut may be threadedly attached to the buffer element, via interaction of the externally threaded portion of the buffer element and the internally threaded portion of the collar nut, and wherein an internally threaded collar screw aperture is formed the collar nut so as to be aligned with the internally threaded buffer screw aperture, when the collar nut is appropriately, threadedly attached to the buffer element, and wherein when the internally threaded collar screw aperture is aligned with the internally threaded buffer screw aperture, the set screw may be threadedly inserted within at least a portion of the internally threaded collar screw aperture and the aligned internally threaded buffer screw aperture; an adjustment bolt, wherein the adjustment bolt comprises a head portion and an externally threaded body portion extending from the head portion, wherein a capture pin recess is formed in a terminal end of the adjustment bolt, wherein the capture pin recess is formed so as to accept at least a portion of a capture pin within the capture pin recess, and wherein one or more recesses are formed around the outer circumference of the head portion; a slidable collar, wherein the slidable collar includes a ring portion, wherein the ring portion surrounds a core portion, wherein the ring portion is spaced apart from the core portion by two or more legs, and wherein prong apertures are defined between the ring portion, the core portion, and the legs, wherein each of the legs corresponds to a longitudinally extending slot, wherein each prong aperture is formed so as to allow a portion of a prong to be fitted therethrough, such that the slidable collar is repeatably slidable along at least a portion of the buffer element, wherein an internally threaded collar aperture is formed through the core portion, wherein the internally threaded collar aperture includes threads that correspond to the externally threaded body portion of the adjustment bolt, and wherein the slidable collar may be threadedly attached to at least a portion of the adjustment bolt, via interaction of the externally threaded body portion of the adjustment bolt and the internally threaded collar aperture of the slidable collar, such that rotational movement of the adjustment bolt relative to the buffer element produces longitudinal movement of the slidable collar along the buffer element; a buffer spacer, wherein the buffer spacer includes an internally threaded buffer spacer aperture formed through the buffer spacer, wherein the internally threaded buffer spacer aperture includes threads that correspond to the externally threaded body portion of the adjustment bolt, such that the buffer spacer may be threadedly attached to the adjustment bolt, via interaction of the externally threaded body portion of the adjustment bolt and the internally threaded buffer spacer aperture of the buffer spacer, wherein a capture pin recess is formed in a terminal end of the adjustment bolt, and wherein the capture pin recess is formed so as to accept at least a portion of the capture pin within the capture pin recess; a weight element, wherein the weight element is sized so as to be fitted within at least a portion of the spacer cavity of the buffer element, and wherein the weight element may be abutted against the capture pin to assist in maintaining the capture pin within at least portions of the capture pin recess of the buffer spacer and the capture pin recess of the adjustment bolt; and an end cap, wherein an extension portion of the end cap may be abutted against the weight element to assist in maintaining the weight element within the spacer cavity.

In certain exemplary, nonlimiting embodiments of the present disclosure, the adjustable buffer system optionally includes at least some of a buffer element, wherein the buffer element includes a collar cavity and a spacer cavity, wherein a bolt aperture is formed between the collar cavity and the spacer cavity, wherein an externally threaded portion extends from the first end of the buffer element, wherein two or more longitudinally extending slots are formed in at least a portion of the buffer element, extending from the first end of the buffer element, and wherein a prong is defined between each longitudinally extending slot; an adjustment bolt, wherein the adjustment bolt comprises a head portion and an externally threaded body portion extending from the head portion, wherein a capture pin recess is formed in a terminal end of the adjustment bolt, wherein the capture pin recess is formed so as to accept at least a portion of a capture pin within the capture pin recess, and wherein one or more recesses are formed around the outer circumference of the head portion; a slidable collar, wherein the slidable collar includes a ring portion surrounding a core portion, wherein the ring portion is spaced apart from the core portion by two or more legs, and wherein prong apertures are defined between the ring portion, the core portion, and the legs, wherein each of the legs corresponds to a longitudinally extending slot, wherein each prong aperture is formed so as to allow a portion of a prong to be fitted therethrough, such that the slidable collar is repeatably slidable along at least a portion of the buffer element, wherein an internally threaded collar aperture is formed through the core portion, wherein the internally threaded collar aperture includes threads that correspond to the externally threaded body portion of the adjustment bolt, and wherein the slidable collar may be threadedly attached to at least a portion of the adjustment bolt, via interaction of the externally threaded body portion of the adjustment bolt and the internally threaded collar aperture of the slidable collar, such that rotational movement of the adjustment bolt relative to the buffer element produces longitudinal movement of the slidable collar along the buffer element; and a buffer spacer, wherein the buffer spacer includes an internally threaded buffer spacer aperture formed through the buffer spacer, wherein the internally threaded buffer spacer aperture includes threads that correspond to the externally threaded body portion of the adjustment bolt, such that the buffer spacer may be threadedly attached to the adjustment bolt, via interaction of the externally threaded body portion of the adjustment bolt and the internally threaded buffer spacer aperture of the buffer spacer, wherein a capture pin recess is formed in a terminal end of the adjustment bolt, and wherein the capture pin recess is formed so as to accept at least a portion of the capture pin within the capture pin recess.

Accordingly, the presently disclosed systems, methods, and/or apparatuses provide an adjustable buffer system that allows a user to adjust the pre-load of the buffer spring.

The presently disclosed systems, methods, and/or apparatuses optionally separately provide an adjustable buffer system that allows a user to adjust the tension of the buffer spring.

The presently disclosed systems, methods, and/or apparatuses optionally separately provide an adjustable buffer system that may optionally provide increased bolt lock time.

The presently disclosed systems, methods, and/or apparatuses optionally separately provide an adjustable buffer system that reduces felt recoil.

The presently disclosed systems, methods, and/or apparatuses optionally separately provide an adjustable buffer system that can be utilized in conjunction with a standard buffer spring.

The presently disclosed systems, methods, and/or apparatuses optionally separately provide an adjustable buffer system that allows the recoil system to be "tuned".

The presently disclosed systems, methods, and/or apparatuses optionally separately provide an adjustable buffer system that allows a user to "dial" the collar nut on the buffer element until a desired pressure to slow the bolt has been found.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
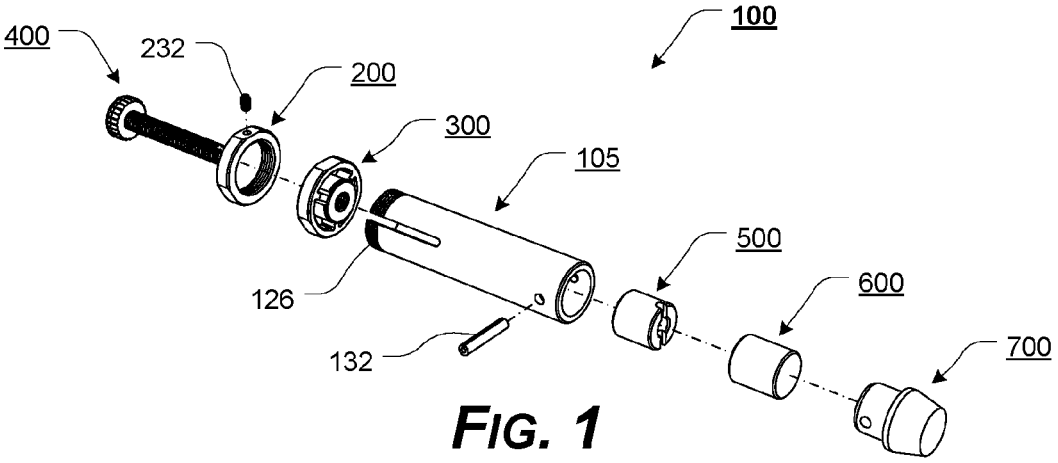
FIG. 1 illustrates an upper, rear, perspective, exploded view of certain components of an exemplary embodiment of an adjustable buffer system, according to the presently disclosed systems, methods, and/or apparatuses.
Figure 2:
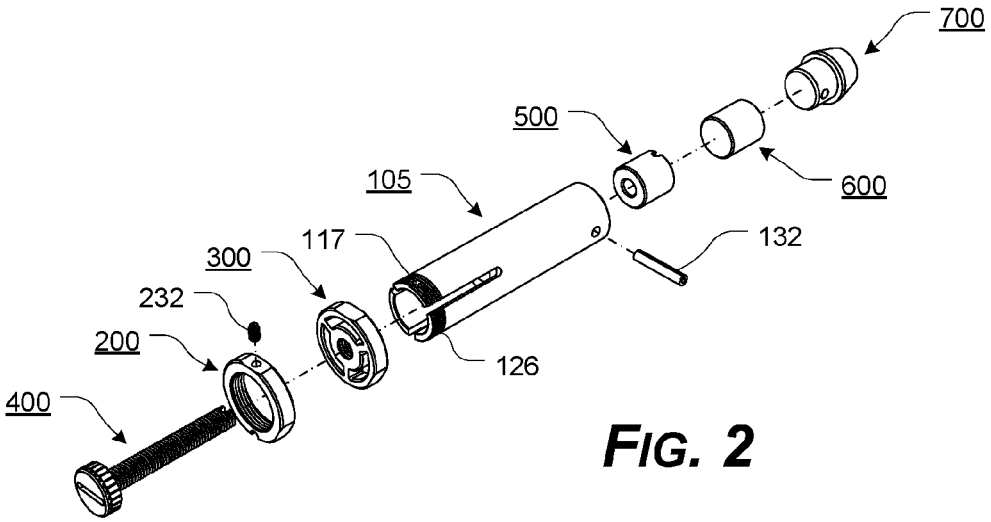
FIG. 2 illustrates an upper, front, perspective, exploded view of certain components of an exemplary embodiment of an adjustable buffer system, according to the presently disclosed systems, methods, and/or apparatuses.
Figure 3:
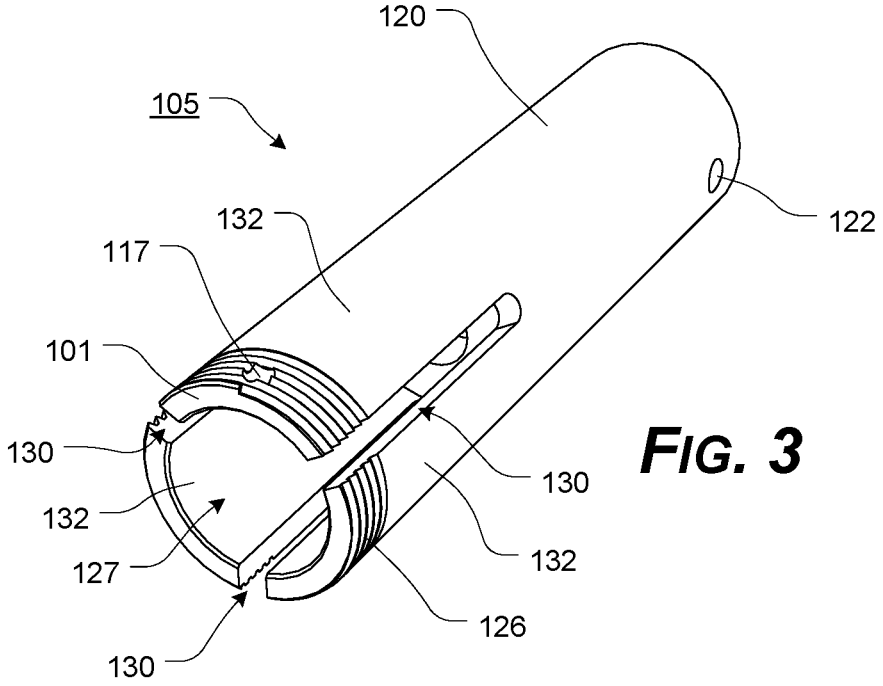
FIG. 3 illustrates an upper, front perspective view of an exemplary embodiment of a buffer element, according to the presently disclosed systems, methods, and/or apparatuses.
Figure 4:
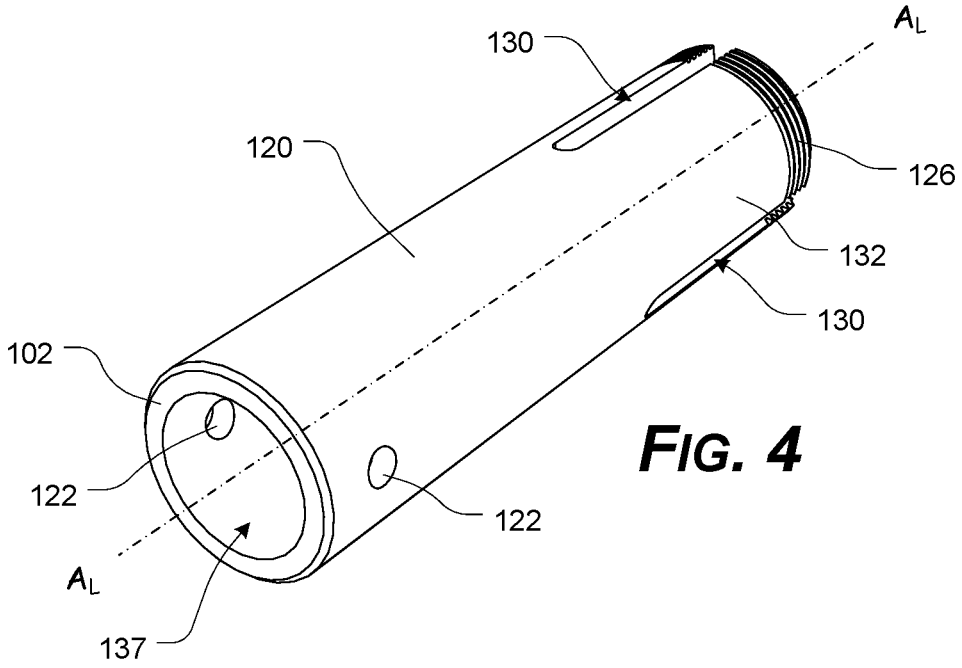
FIG. 4 illustrates an upper, rear perspective view of an exemplary embodiment of a buffer element, according to the presently disclosed systems, methods, and/or apparatuses.
Figure 5:
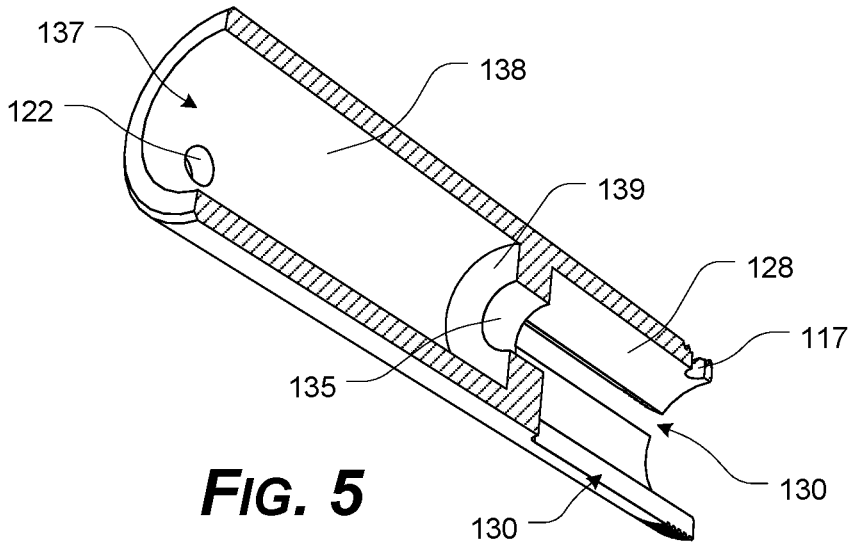
FIG. 5 illustrates a lower, rear, cutaway view of an exemplary embodiment of a buffer element, according to the presently disclosed systems, methods, and/or apparatuses.
Figure 6:
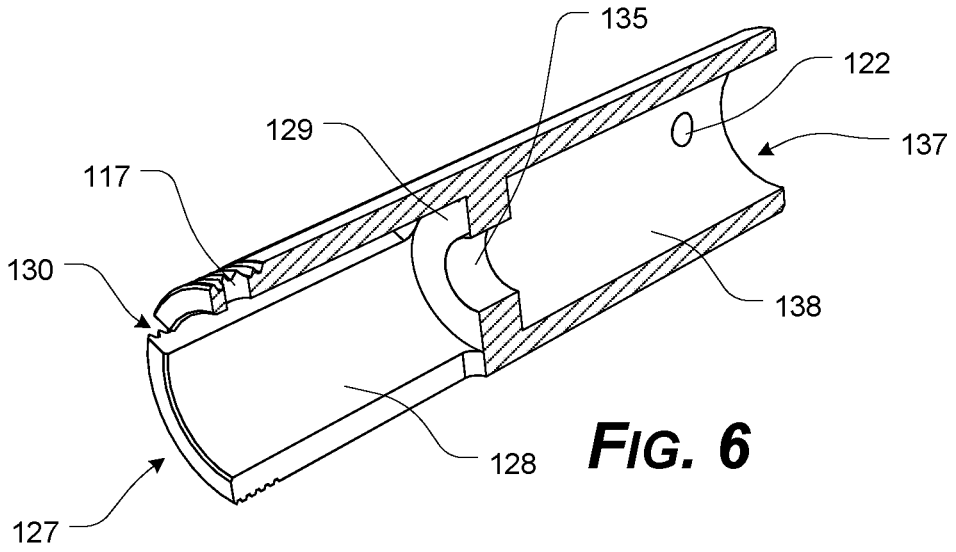
FIG. 6 illustrates an upper, front, cutaway view of an exemplary embodiment of a buffer element, according to the presently disclosed systems, methods, and/or apparatuses.
Figure 7:
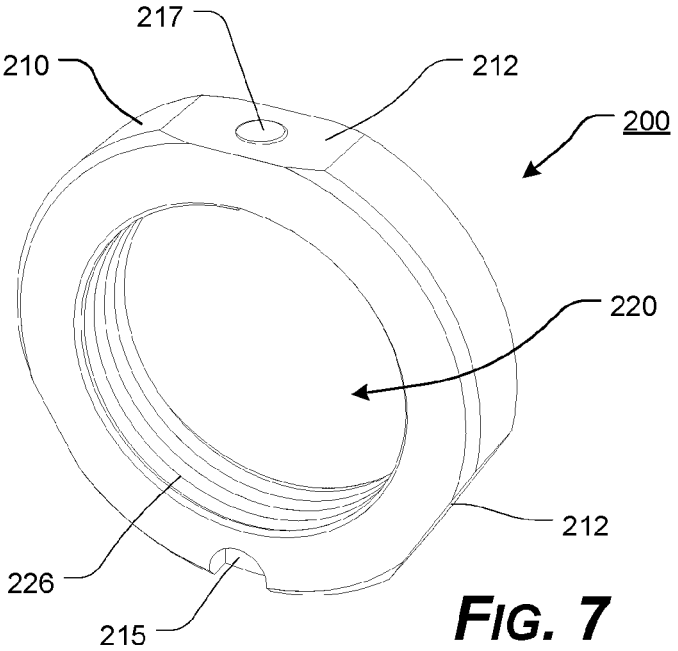
FIG. 7 illustrates a front perspective view of a collar nut, according to the presently disclosed systems, methods, and/or apparatuses.
Figure 8:
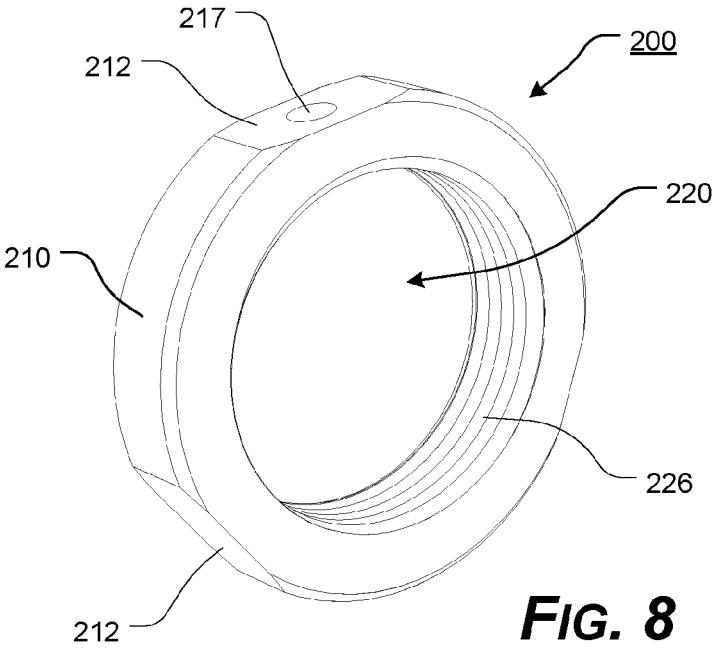
FIG. 8 illustrates a rear perspective view of a collar nut, according to the presently disclosed systems, methods, and/or apparatuses.
Figure 9:
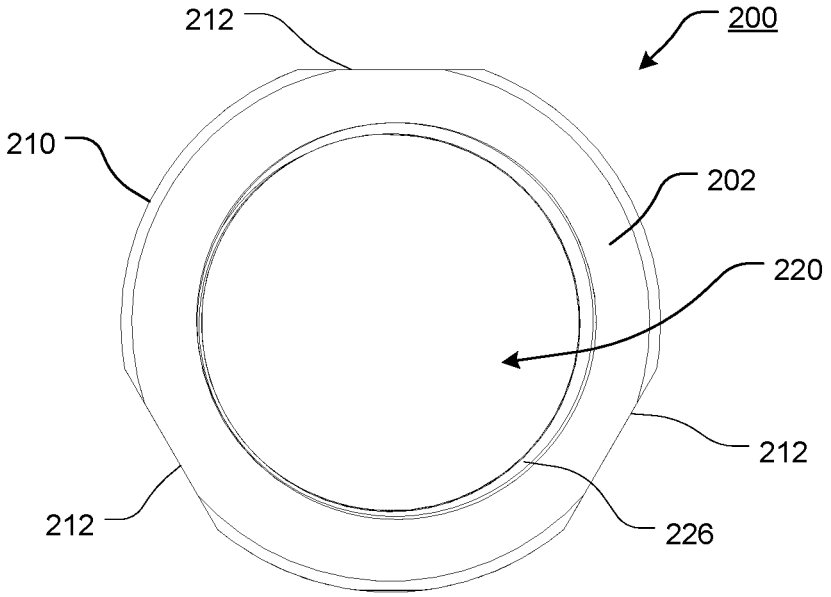
FIG. 9 illustrates a rear view of a collar nut, according to the presently disclosed systems, methods, and/or apparatuses.
Figure 10:
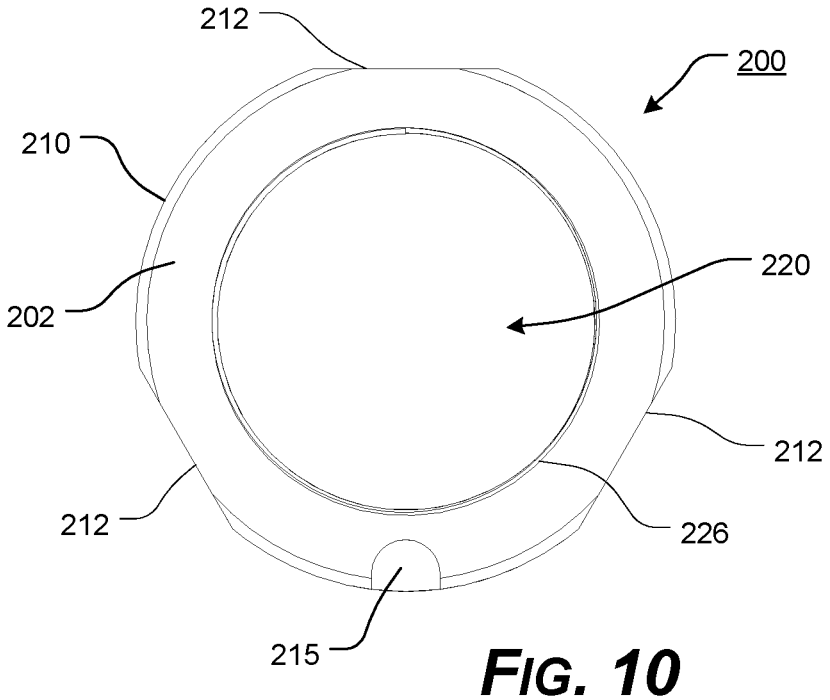
FIG. 10 illustrates a front view of a collar nut, according to the presently disclosed systems, methods, and/or apparatuses.
Figure 11:
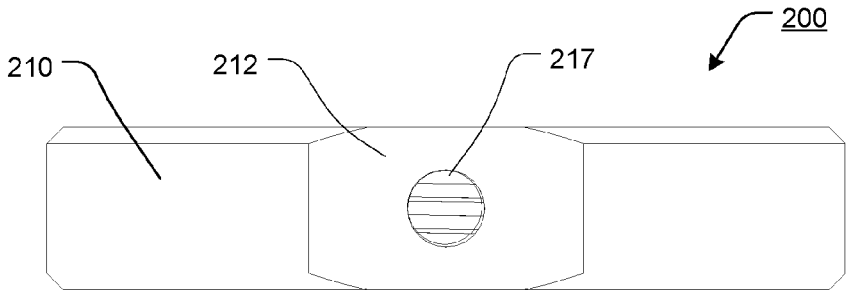
FIG. 11 illustrates a top view of a collar nut, according to the presently disclosed systems, methods, and/or apparatuses.
Figure 12:
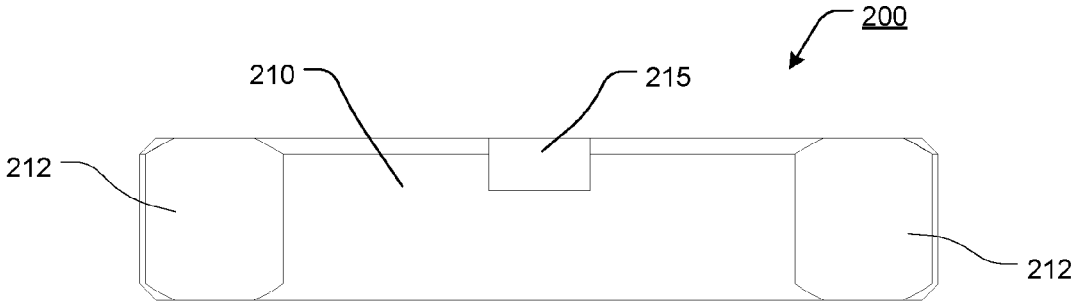
FIG. 12 illustrates a bottom view of a collar nut, according to the presently disclosed systems, methods, and/or apparatuses.
Figure 13:
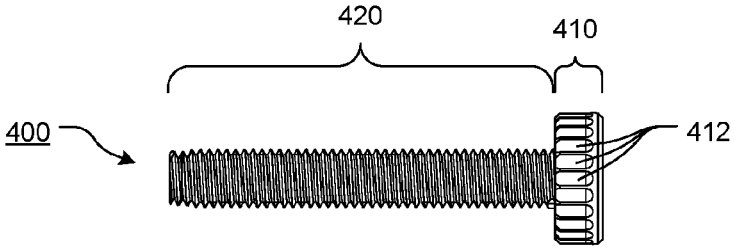
FIG. 13 illustrates a side view of an exemplary embodiment of an adjustable bolt, according to the presently disclosed systems, methods, and/or apparatuses.
Figure 14:
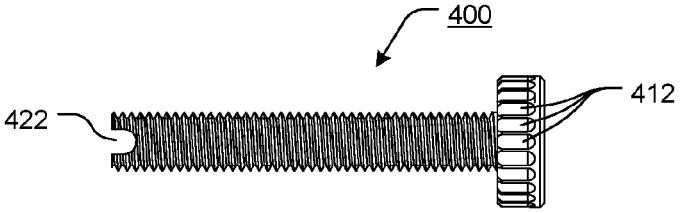
FIG. 14 illustrates a top view of an exemplary embodiment of an adjustable bolt, according to the presently disclosed systems, methods, and/or apparatuses.
Figure 15:
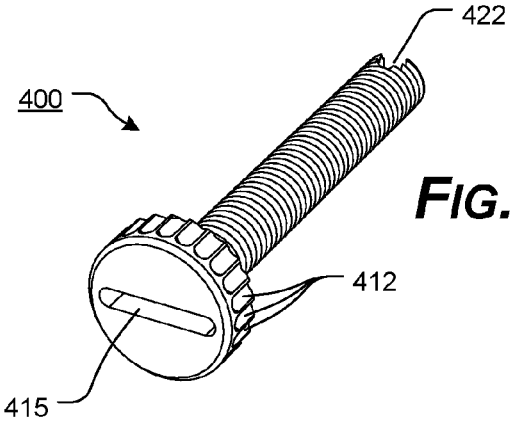
FIG. 15 illustrates a perspective view of an exemplary embodiment of an adjustable bolt, according to the presently disclosed systems, methods, and/or apparatuses.
Figure 16:
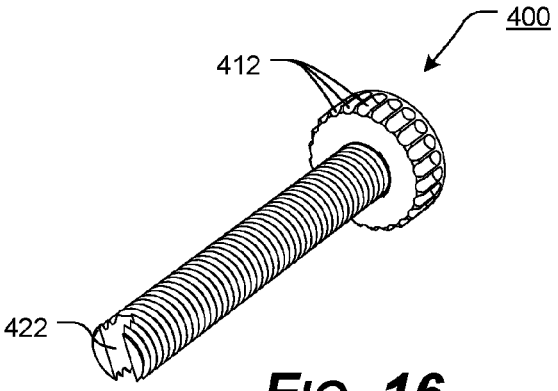
FIG. 16 illustrates a perspective view of an exemplary embodiment of an adjustable bolt, according to the presently disclosed systems, methods, and/or apparatuses.
Figure 17:
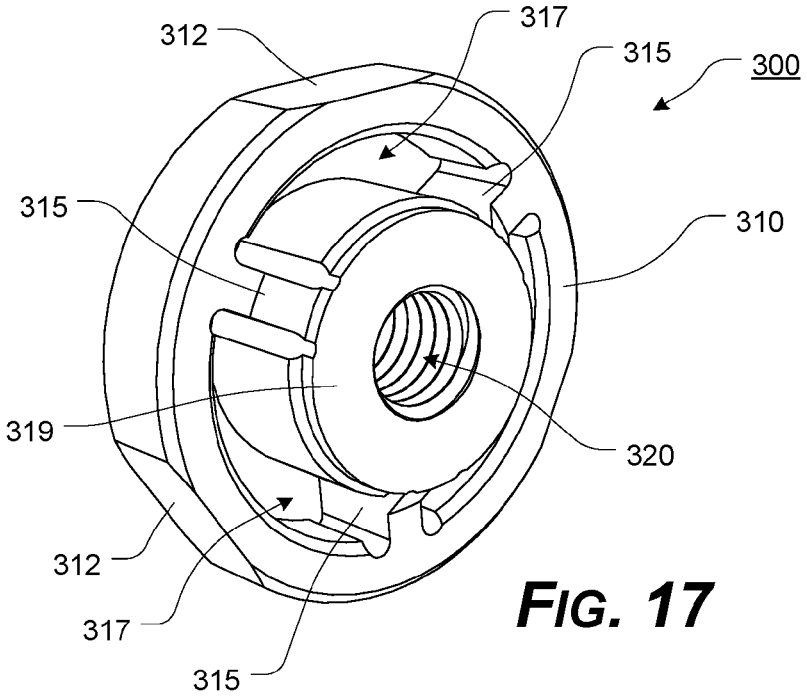
FIG. 17 illustrates a rear perspective view of an exemplary embodiment of a slidable collar, according to the presently disclosed systems, methods, and/or apparatuses.
Figure 18:
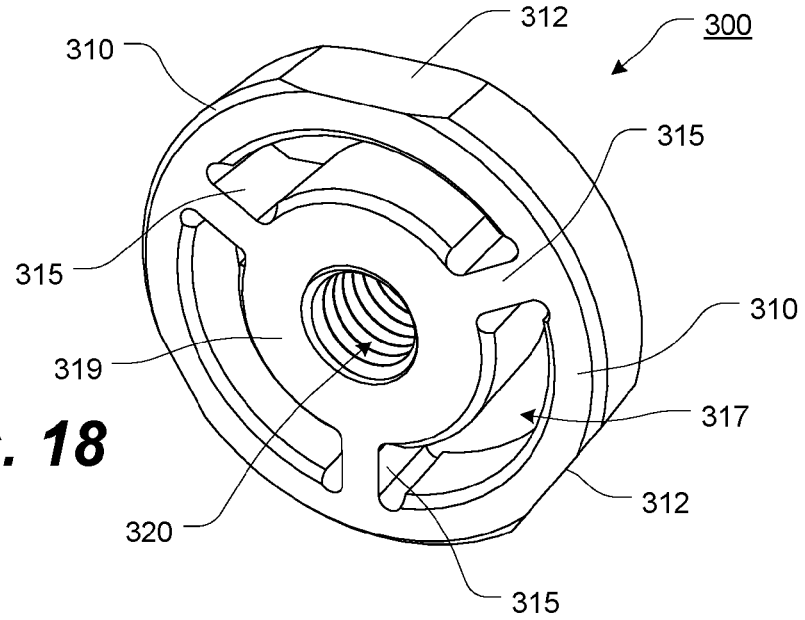
FIG. 18 illustrates a front perspective view of an exemplary embodiment of a slidable collar, according to the presently disclosed systems, methods, and/or apparatuses.
Figure 19:
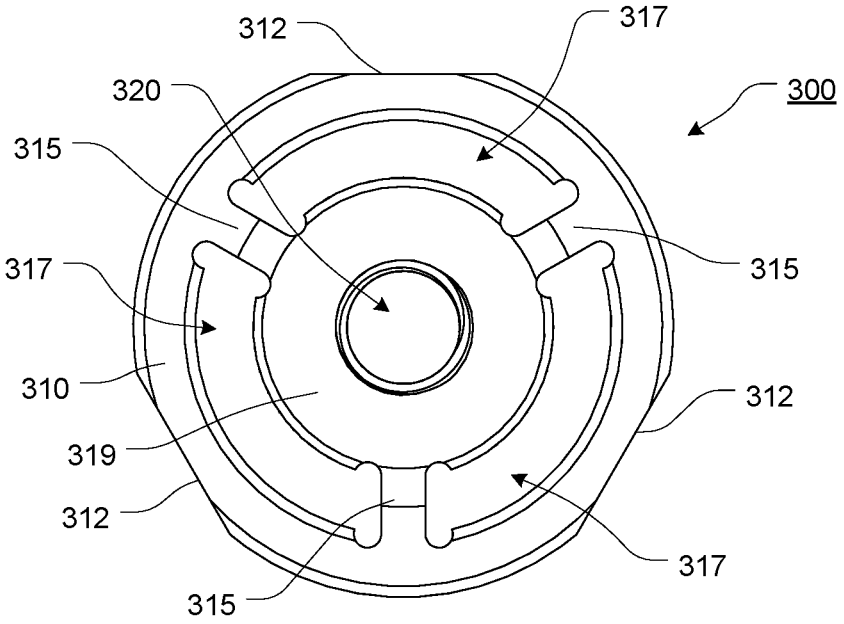
FIG. 19 illustrates a rear view of an exemplary embodiment of a slidable collar, according to the presently disclosed systems, methods, and/or apparatuses.
Figure 20:
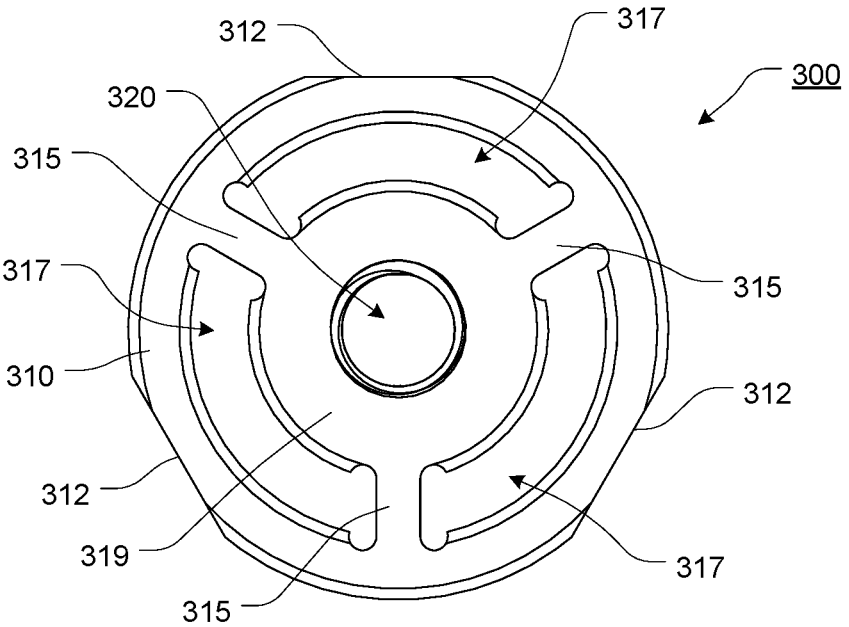
FIG. 20 illustrates a front view of an exemplary embodiment of a slidable collar, according to the presently disclosed systems, methods, and/or apparatuses.
Figure 21:
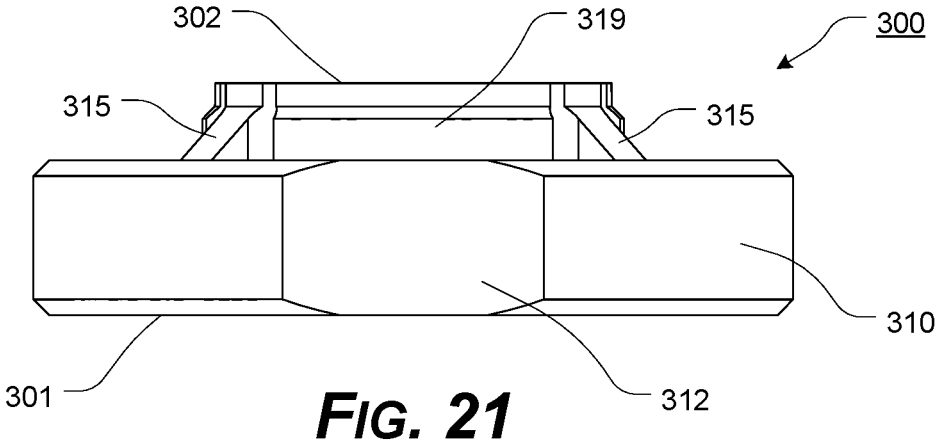
FIG. 21 illustrates a top view of an exemplary embodiment of a slidable collar, according to the presently disclosed systems, methods, and/or apparatuses.
Figure 22:
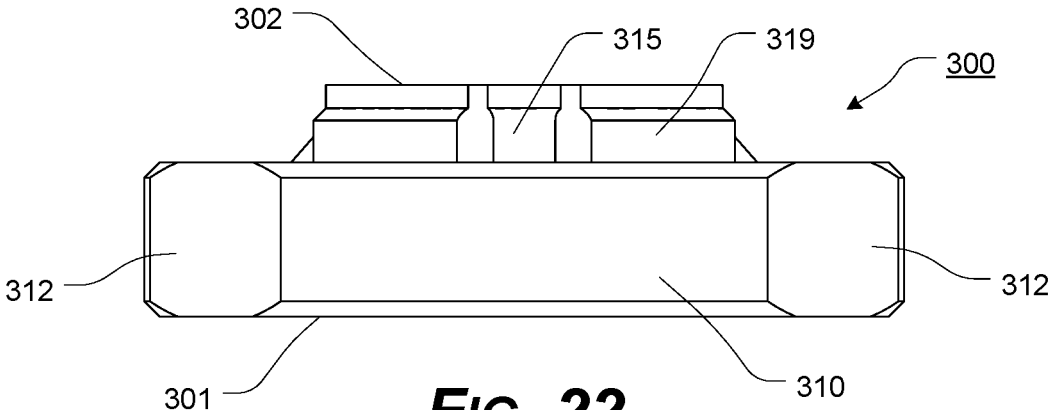
FIG. 22 illustrates a bottom view of an exemplary embodiment of a slidable collar, according to the presently disclosed systems, methods, and/or apparatuses.
Figure 23:
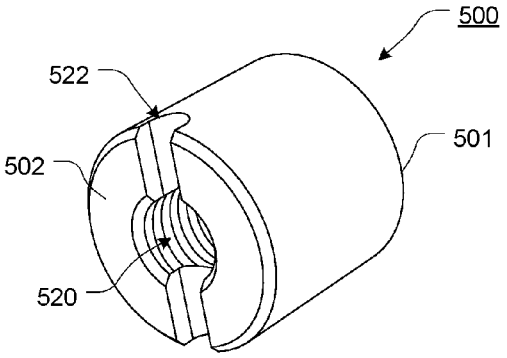
FIG. 23 illustrates a rear perspective view of an exemplary embodiment of a buffer spacer, according to the presently disclosed systems, methods, and/or apparatuses.
Figure 24:
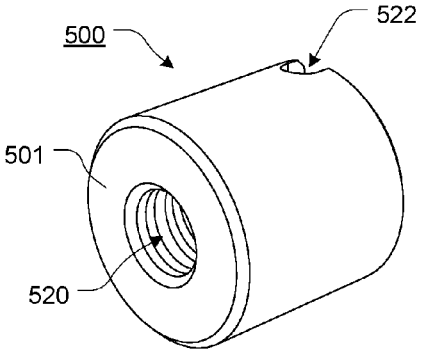
FIG. 24 illustrates a front perspective view of an exemplary embodiment of a buffer spacer, according to the presently disclosed systems, methods, and/or apparatuses.
Figure 25:
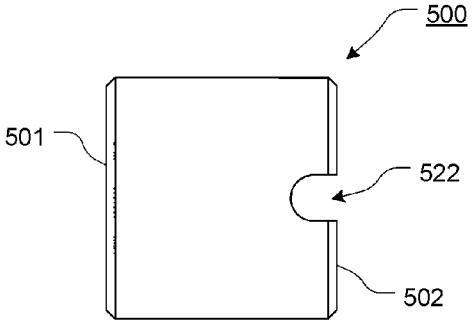
FIG. 25 illustrates a top view of an exemplary embodiment of a buffer spacer, according to the presently disclosed systems, methods, and/or apparatuses.
Figure 26:
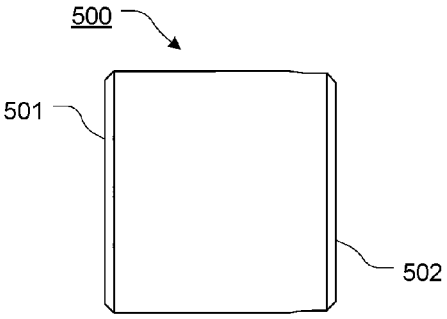
FIG. 26 illustrates a bottom view of an exemplary embodiment of a buffer spacer, according to the presently disclosed systems, methods, and/or apparatuses.
Figure 27:
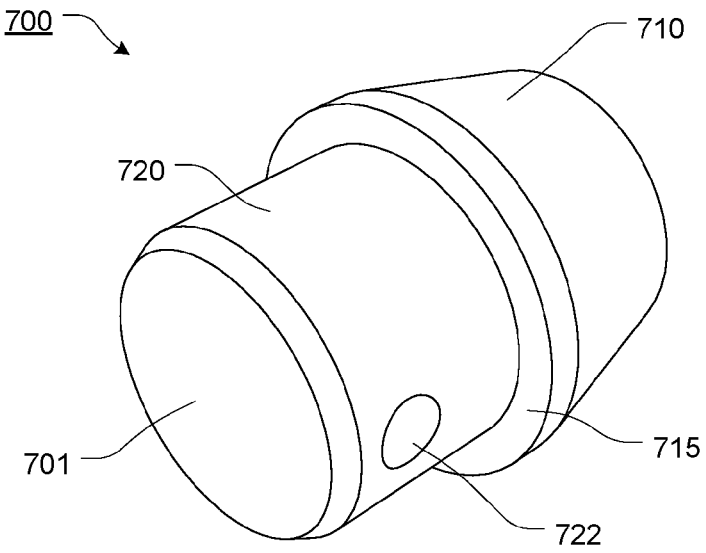
FIG. 27 illustrates an upper, front perspective view of an exemplary embodiment of an end cap, according to the presently disclosed systems, methods, and/or apparatuses.
Figure 28:
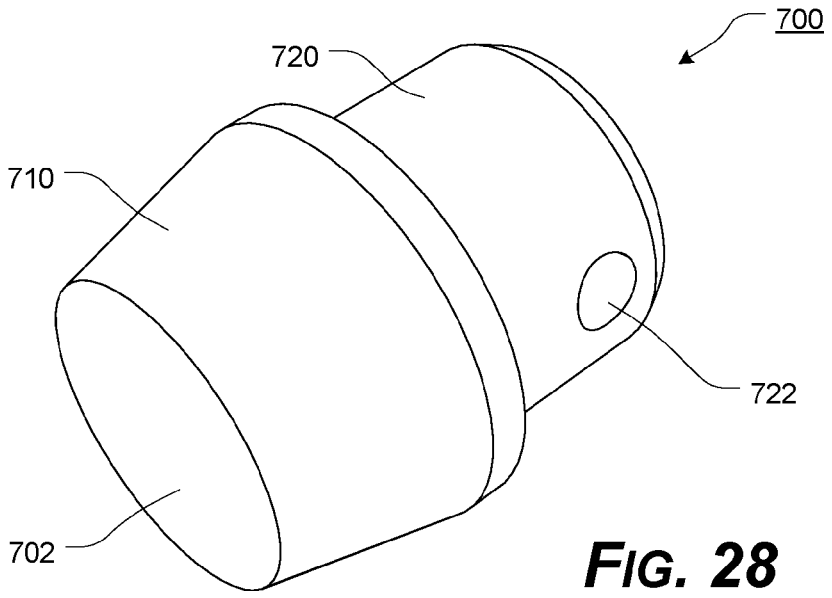
FIG. 28 illustrates an upper, rear perspective view of an exemplary embodiment of an end cap, according to the presently disclosed systems, methods, and/or apparatuses.
Figure 29:
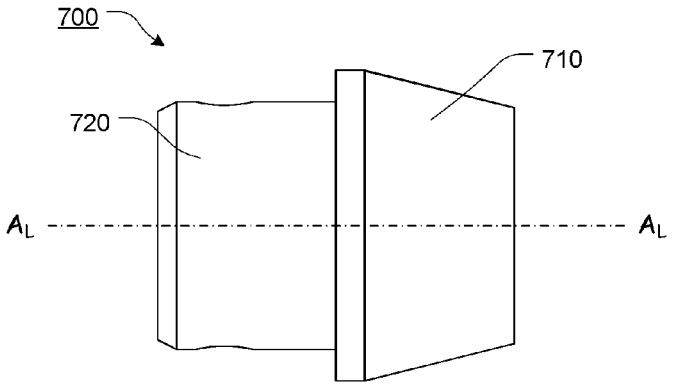
FIG. 29 illustrates a top view of an exemplary embodiment of an end cap, according to the presently disclosed systems, methods, and/or apparatuses.
Figure 30:
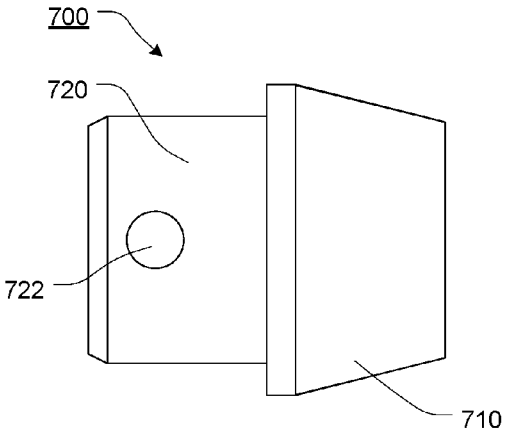
FIG. 30 illustrates a side view of an exemplary embodiment of an end cap, according to the presently disclosed systems, methods, and/or apparatuses.
Figure 31:
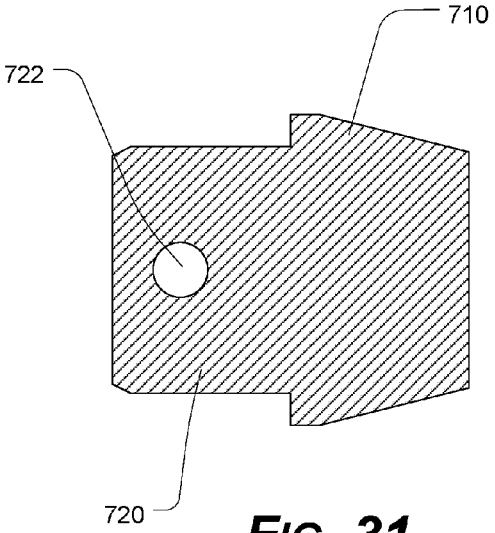
FIG. 31 illustrates a cross-sectional view of the end cap, according to the presently disclosed systems, methods, and/or apparatuses.
Figure 32:
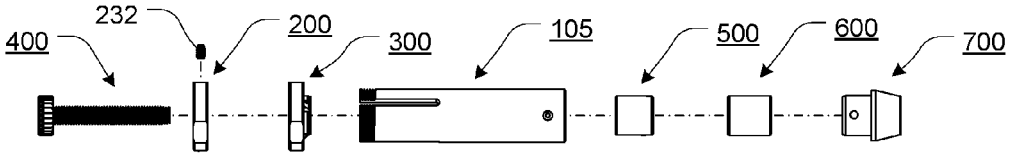
FIG. 32 illustrates a side, exploded view of certain components of an exemplary embodiment of an adjustable buffer system, according to the presently disclosed systems, methods, and/or apparatuses.
Figure 33:
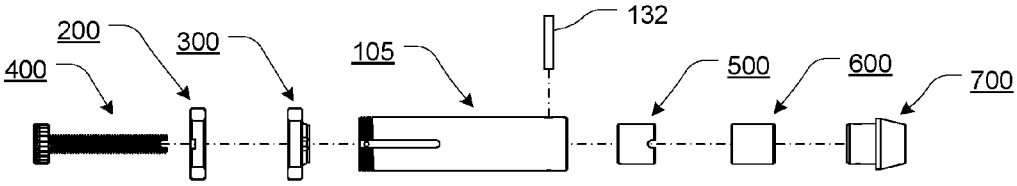
FIG. 33 illustrates a bottom, exploded view of certain components of an exemplary embodiment of an adjustable buffer system, according to the presently disclosed systems, methods, and/or apparatuses.
Figure 34:
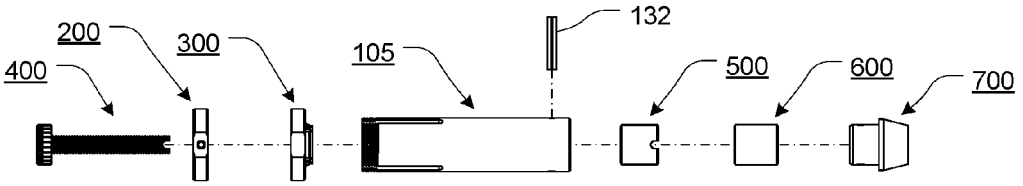
FIG. 34 illustrates a top, exploded view of certain components of an exemplary embodiment of an adjustable buffer system, according to the presently disclosed systems, methods, and/or apparatuses.
Figure 35:
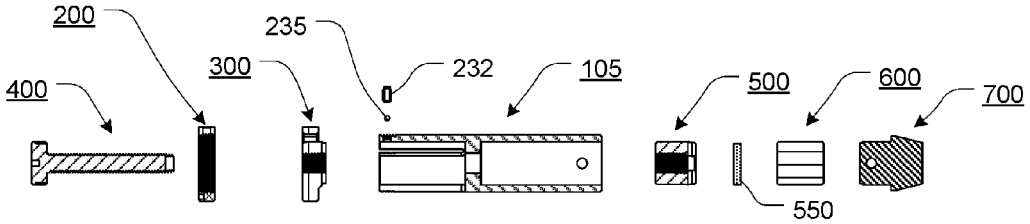
FIG. 35 illustrates a side, exploded, cross-sectional view of certain components of an exemplary embodiment of an adjustable buffer system, according to the presently disclosed systems, methods, and/or apparatuses.
Figure 36:
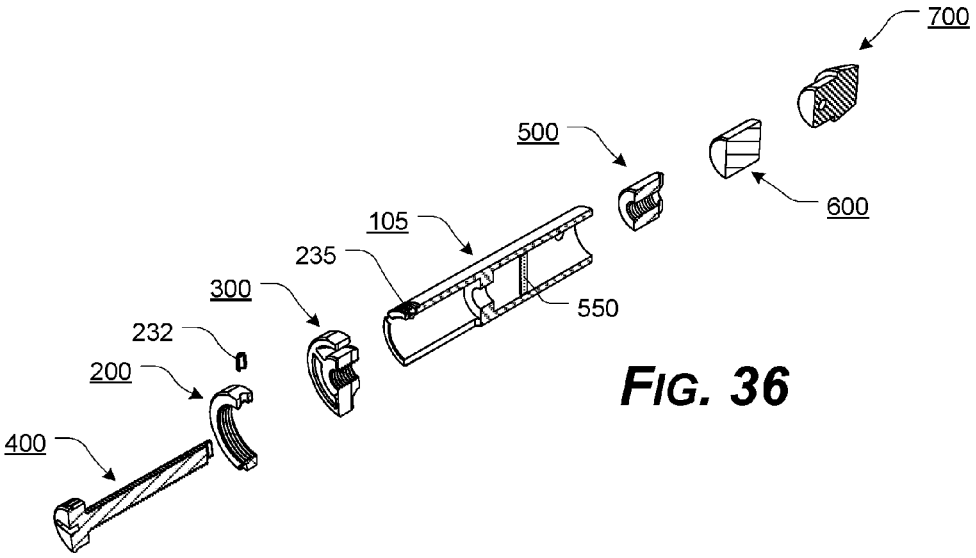
FIG. 36 illustrates a perspective, exploded, cross-sectional view of certain components of an exemplary embodiment of an adjustable buffer system, according to the presently disclosed systems, methods, and/or apparatuses.

For simplicity and clarification, the design factors and operating principles of the adjustable buffer system according to the presently disclosed systems, methods, and/or apparatuses are explained with reference to various exemplary embodiments of an adjustable buffer system according to the presently disclosed systems, methods, and/or apparatuses. The basic explanation of the design factors and operating principles of the adjustable buffer system is applicable for the understanding, design, and operation of the adjustable buffer system of the presently disclosed systems, methods, and/or apparatuses. It should be appreciated that the adjustable buffer system can be adapted to many applications where an adjustable buffer system can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "adjustable buffer system", "collar nut", "slidable collar", and "firearm" are used for basic explanation and understanding of the operation of the presently disclosed systems, methods, and/or apparatuses. Therefore, the terms "adjustable buffer system", "collar nut", "slidable collar", and "firearm" are not to be construed as limiting the systems, methods, and/or apparatuses of the present disclosure. Thus, for example, the term "firearm" is to be understood to broadly include any firearm or other similar handheld or shoulder mounted device or tool.

For simplicity and clarification, the adjustable buffer system of the present disclosure will be described as being used in conjunction with a firearm, such as an AR-15 or M4 style rifle or carbine. However, it should be appreciated that these are merely exemplary embodiments of the adjustable buffer system and are not to be construed as limiting the presently disclosed systems, methods, and/or apparatuses. Thus, the adjustable buffer system of the present disclosure may be utilized in conjunction with any firearm or rifle, such as, for example, an AR-10 style rifle, air rifle, paintball marker, Airsoft rifle, replica rifle, or any other tool, device, or object.

Turning now to the drawing FIGS., FIGS. 1-45 illustrate certain elements and/or aspects of an exemplary embodiment of the adjustable buffer system 100, according to the presently disclosed systems, methods, and/or apparatuses. In illustrative, non-limiting embodiment(s) of the present disclosure, as illustrated in FIGS. 1-45, the adjustable buffer system 100 comprises at least some of a buffer element 105, a collar nut 200, a slidable collar 300, an adjustment bolt 400, a buffer spacer 500, an optional weight element 600, and an optional end cap 700.

As illustrated most clearly in FIGS. 3-6, the buffer element 105 comprises a buffer element body portion 120. The buffer element 105 comprises an elongate portion of material extending, along a longitudinal axis $A_L$, from a first end 101 to a second end 102 of the buffer element 105.

The buffer element 105 includes a collar cavity 127 defined by one or more interior side walls 128 and a collar cavity bottom wall 129. The collar cavity 127 extends from an open first end 101 of the collar cavity 127, along the one or more interior side walls 128, to the collar cavity bottom wall 129.

The buffer element 105 further includes a spacer cavity 137 defined by one or more interior side walls 138 and a spacer cavity bottom wall 139. The spacer cavity 137 extends from an open second end 102 of the spacer cavity 137, along the one or more interior side walls 138, to the spacer cavity bottom wall 139.

A bolt aperture 135 is formed between the collar cavity bottom wall 129 and the spacer cavity bottom wall 139, which joins the collar cavity 127 and the spacer cavity 137.

An externally threaded portion 126 extends from the first end 101, along at least a portion of the buffer element body portion 120.

An internally threaded, buffer screw aperture 117 is formed in the buffer element body 120, proximate the first end 101 of the body portion 120. In various exemplary, nonlimiting embodiments, the buffer screw aperture 117 is formed through the buffer element body 120 within a portion of the externally threaded portion 126. In various exemplary embodiments, the buffer screw aperture 117 is internally threaded so as to accept an externally threaded set screw 232.

Figure 37:
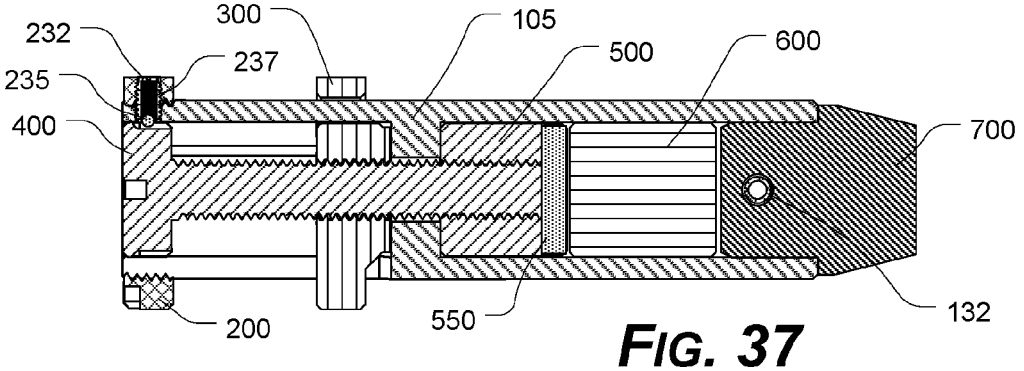
FIG. 37 illustrates a side, cross-sectional view of certain assembled components of an exemplary embodiment of an adjustable buffer system, according to the presently disclosed systems, methods, and/or apparatuses.
Figure 38:
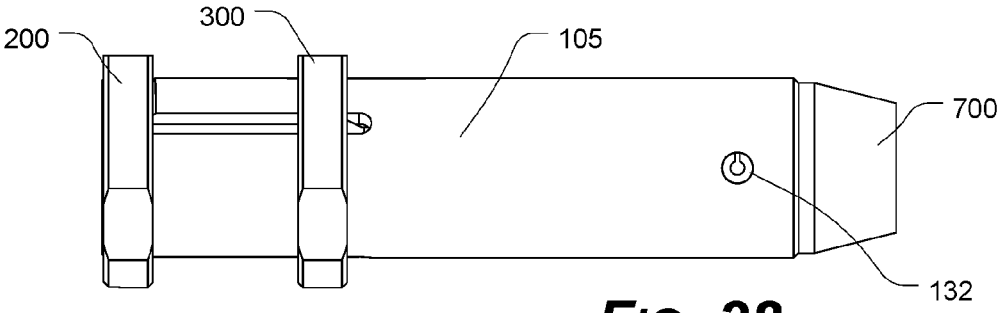
FIG. 38 illustrates a side view of certain assembled components of an exemplary embodiment of an adjustable buffer system, wherein the slidable collar is in a first position, according to the presently disclosed systems, methods, and/or apparatuses.
Figure 39:
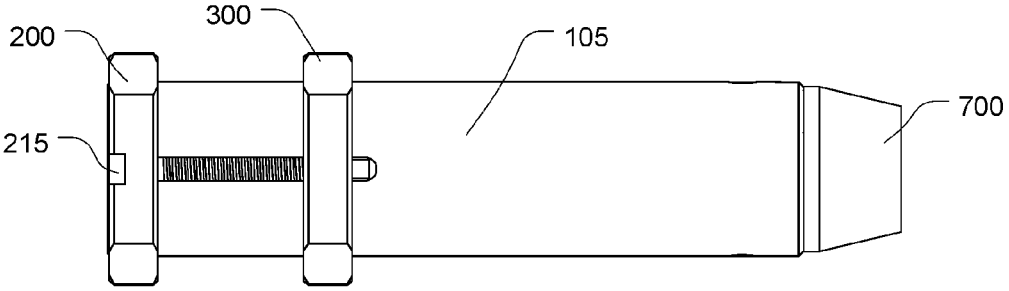
FIG. 39 illustrates a bottom view of certain assembled components of an exemplary embodiment of an adjustable buffer system, according to the presently disclosed systems, methods, and/or apparatuses.
Figure 40:
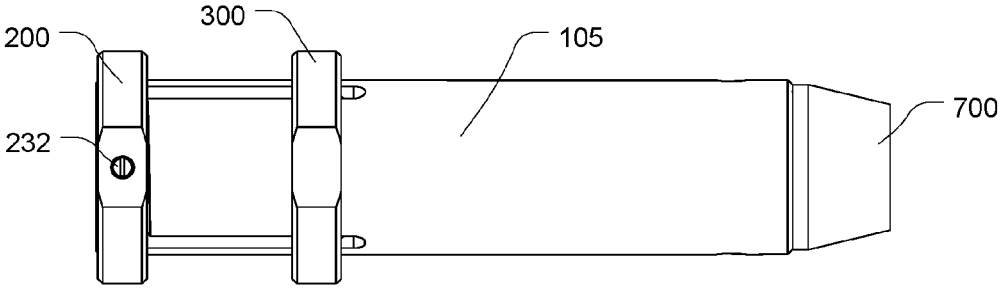
FIG. 40 illustrates a top view of certain assembled components of an exemplary embodiment of an adjustable buffer system, according to the presently disclosed systems, methods, and/or apparatuses.
Figure 41:
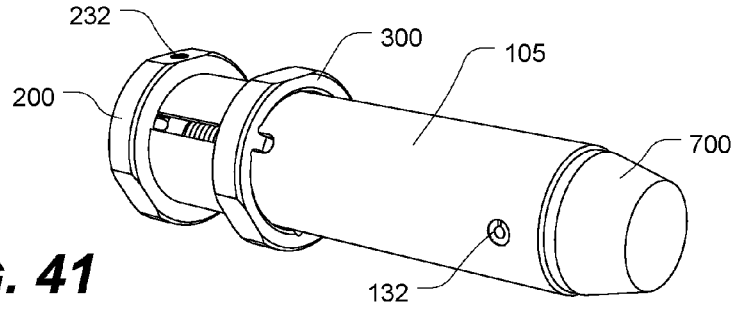
FIG. 41 illustrates a rear perspective view of certain assembled components of an exemplary embodiment of an adjustable buffer system, according to the presently disclosed systems, methods, and/or apparatuses.
Figure 42:
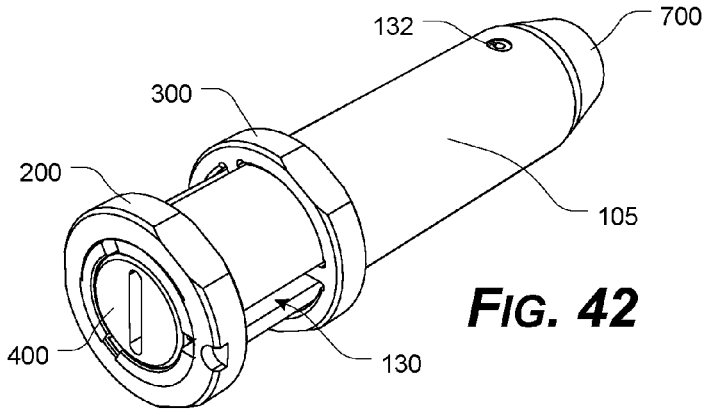
FIG. 42 illustrates a front perspective view of certain assembled components of an exemplary embodiment of an adjustable buffer system, according to the presently disclosed systems, methods, and/or apparatuses.
Figure 43:
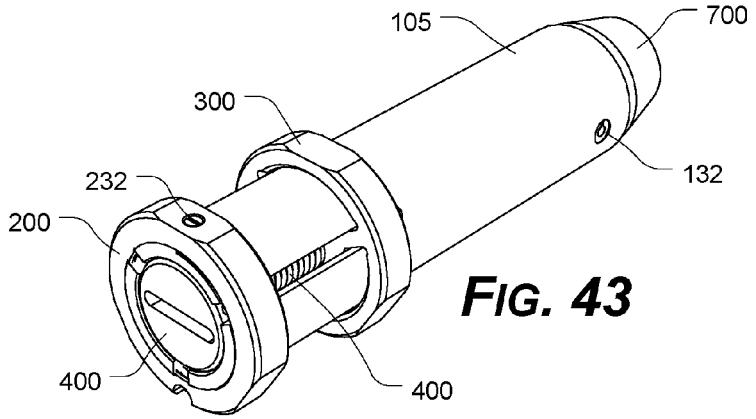
FIG. 43 illustrates a front perspective view of certain assembled components of an exemplary embodiment of an adjustable buffer system, according to the presently disclosed systems, methods, and/or apparatuses.
Figure 44:
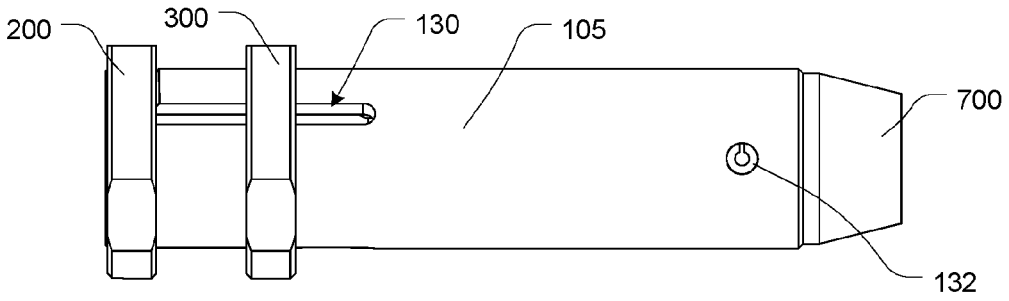
FIG. 44 illustrates a side view of certain assembled components of an exemplary embodiment of an adjustable buffer system, wherein the slidable collar is in a second position, according to the presently disclosed systems, methods, and/or apparatuses.
Figure 45:
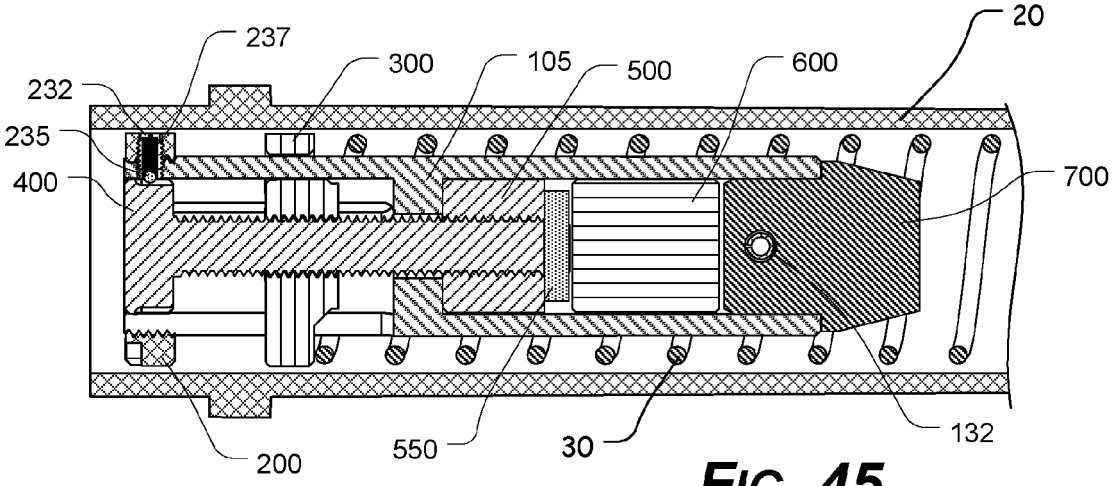
FIG. 45 illustrates a side, cross-sectional view of certain assembled components of an exemplary embodiment of an adjustable buffer system, wherein the slidable collar is in a second position and wherein the adjustable buffer system is positioned within an exemplary buffer tube, according to the presently disclosed systems, methods, and/or apparatuses.

Optionally, as illustrated most clearly in FIGS. 37 and 45, the set screw 232 includes an internal recess that includes a captured, detent 235. In these exemplary embodiments, a spring or other spring biasing element 237, within the internal recess, supplies a spring biasing force to the detent 235. When the adjustment bolt 400 is in a determined, attached position, a portion of the detent 235 interacts with and is captured within a portion of a recess 412, formed around the outer circumference of the head portion 410 of the adjustment bolt 400, to maintain the adjustment bolt 400 in a desired rotational position relative to the buffer element 105.

In various exemplary, nonlimiting embodiments, the detent 235 comprises a spring biased ball detent.

At least one, and optionally three, longitudinally extending slots 130 are formed in at least a portion of the buffer element body portion 120, extending from the first end 101 toward (and optionally to) the collar cavity bottom wall 129. In various exemplary embodiments, each of the longitudinally extending slots 130 is equally spaced from each other longitudinally extending slot 130.

A prong 132 is defined between each longitudinally extending slot 130.

In various exemplary embodiments, a buffer element retaining pin aperture 122 extends at least partially through the buffer element body portion 120, proximate the second end 102 of the buffer element 105 and is formed so as to accept at least a portion of a retaining pin 132 therethrough.

In various exemplary embodiments, the buffer element 105 is substantially rigid and is formed of stainless steel. Alternate materials of construction of the buffer element 105 may include one or more of the following: steel, aluminum, titanium, and/or other metals, as well as various alloys and composites thereof. Thus, it should be understood that the material or materials used to form the buffer element 105 is a design choice based on the desired appearance and/or functionality of the buffer element 105.

If included, the weight element 600 is sized so as to be fitted within the spacer cavity 137 of the buffer element 105. The actual weight of the weight element 600 can vary, depending upon the desired functionality of the weight element 600 and the overall functional weight of the buffer element 105. In various exemplary embodiments, the weight element 600 may comprise a portion of stainless steel or tungsten. Alternatively, the weight element 600 may comprise a solid portion of material, a powdered or granulated material (such as, for example, loose sand, lead, steel, or other metallic or nonmetallic shot), or a liquid (such as, for example, Mercury).

As illustrated most clearly in FIGS. 7-12, the collar nut 200 comprises a portion of material extending, along a longitudinal axis $A_L$, from a first end 201 to a second end 202, to form a collar nut body 210. A collar nut aperture 220 is formed through the collar nut 200, along the longitudinal axis $A_L$.

At least a portion of the collar nut aperture 220 is internally threaded. The internally threaded portion 226 includes threads that correspond to the externally threaded portion 126 of the buffer element body portion 120. As illustrated most clearly in FIG. 7-12, the collar nut 200 may be threadedly attached to the buffer element body portion 120, via interaction of the externally threaded portion 126 of the buffer element body portion 120 and the internally threaded portion 226 of the collar nut 200.

Thus, by rotating the collar nut 200 relative to the buffer element 105, the position of the collar nut 200 along the buffer element body portion 120 can be adjusted by interaction of the externally threaded portion 126 of the buffer element body portion 120 and the internally threaded portion of the collar nut 200.

A threaded, collar screw aperture 217 is formed the body portion 220 of the collar nut 200. In various exemplary, nonlimiting embodiments, the collar screw aperture 217 is formed through the body portion 220 so as to be aligned with the buffer screw aperture 117, when the collar nut 200 is appropriately, threadedly attached to the buffer element body 120, via interaction of the internally threaded portion 226 and the externally threaded portion 126.

At least one collar recess 215 is formed in the collar nut 200. The number, shape, and placement of the collar recess 215 is a design choice. In various exemplary embodiments, the collar recess 215 is formed so as to interact with a buffer tube detent. If the collar recess 215 interacts with a buffer tube detent, the collar recess 215 may act to counteract rotational forces on the collar 200 and the buffer element 105.

In certain exemplary embodiments, one or more recesses or notches 212 are formed around portions of the collar nut 200. If included, the recesses or notches 212 provide debris channels, such that any matter or debris that comes between the collar nut 200 and the buffer tube 20, within which the buffer element 105 is installed, can be diverted into the recesses or notches 212, so as not to hinder the movement of the collar nut 200 (or buffer element 105) in relation to the buffer tube 20.

In various exemplary embodiments, the collar nut 200 is substantially rigid and is formed of aluminum. Alternate materials of construction of the collar nut 200 may include one or more of the following: steel, stainless steel, titanium, and/or other metals, as well as various alloys and composites thereof. Thus, it should be understood that the material or materials used to form the collar nut 200 is a design choice based on the desired appearance and/or functionality of the collar nut 200.

As illustrated most clearly in FIGS. 13-16, the adjustment bolt 400 comprises a head portion 410 and an externally threaded body portion 420. In various exemplary embodiments, a series of recesses 412 are formed around the outer circumference of the head portion 410. A slot 415 is formed in the head portion 410 and allows rotational force to be applied to the adjustment bolt 400.

A capture pin recess 422 is formed in a terminal end of the adjustment bolt 400, opposite the head portion 410. The capture pin recess 422 is formed so as to accept at least a portion of the capture pin 550 within the capture pin recess 422.

As illustrated most clearly in FIGS. 17-22, the slidable collar 300 comprises a portion of material extending, along a longitudinal axis $A_L$, from a first end 301 to a second end 302. The slidable collar 300 comprises an outer, ring portion 310, which surrounds an inner, core portion 319. The ring portion 310 is spaced apart from the core portion 319 by one or more legs 315. Prong apertures 317 are defined between the ring portion 310, the core portion 319, and the legs 315. Each of the legs 315 corresponds to a longitudinally extending slot 130 and each prong aperture is formed so as to allow a prong 132 to be fitted therethrough and to be repeatably slidable along at least a portion of the buffer element 105.

Thus, the core portion 319 can be slidably fitted within at least a portion of the collar cavity 127, with each leg 315 being slidably fitted within a longitudinally extending slot 130. In this manner, the ring portion 310 extends beyond an outer surface of the buffer element 105 and the slidable collar 300 may be repeatably slidable along at least a portion of the buffer element 105, as defined by the longitudinally extending slots 130.

The legs 315 are formed so as to be aligned with and slidable along the longitudinally extending slots 130 of the buffer element 105, when the slidable collar 300 is positioned about the buffer element 105. Interaction of the legs 315 and the longitudinally extending slots 130 maintains the slidable collar 300 in a substantially consistent rotational position relative to the buffer element 105.

It should be appreciated that the number and placement of legs 315 corresponds to the number and placement of longitudinally extending slots 130. Thus, for example, if two longitudinally extending slots 130 are formed in the buffer element 105, 180° from one another, two corresponding legs 315 will be formed in the slidable collar 300, 180° from one another.

An internally threaded collar aperture 320 is formed through the slidable collar 300, within the core portion 319, along the longitudinal axis $A_L$. The internally threaded collar aperture 320 includes threads that correspond to the externally threaded body portion 420 of the adjustment bolt 400. Thus, the slidable collar 300 may be threadedly attached to the adjustment bolt 400, via interaction of the externally threaded body portion 420 of the adjustment bolt 400 and the internally threaded collar aperture 320 of the slidable collar 300.

Thus, by rotating the adjustment bolt 400 relative to the slidable collar 300, while the slidable collar 300 is kept from rotating relative to the adjustment bolt 400, the position of the slidable collar 300 along the adjustment bolt 400 can be adjusted by interaction of the externally threaded body portion 420 of the adjustment bolt 400 and the internally threaded collar aperture 320 of the slidable collar 300.

In certain exemplary embodiments, one or more recesses or notches 312 are formed around portions of the slidable collar 300. If included, the recesses or notches 312 provide debris channels, such that any matter or debris that comes between the slidable collar 300 and the buffer tube 20 can be diverted into the recesses or notches 312, so as not to hinder the movement of the slidable collar 300 (or buffer element 105) in relation to the buffer tube 20.

In various exemplary embodiments, the slidable collar 300 is substantially rigid and is formed of aluminum. Alternate materials of construction of the slidable collar 300 may include one or more of the following: steel, stainless steel, titanium, and/or other metals, as well as various alloys and composites thereof. Thus, it should be understood that the material or materials used to form the slidable collar 300 is a design choice based on the desired appearance and/or functionality of the slidable collar 300.

As illustrated most clearly in FIGS. 23-26, the buffer spacer 500 comprises a portion of material extending, along a longitudinal axis $A_L$, from a first end 501 to a second end 502. An internally threaded buffer spacer aperture 520 is formed through the buffer spacer 500, along the longitudinal axis $A_L$. The internally threaded buffer spacer aperture 520 includes threads that correspond to the externally threaded body portion 420 of the adjustment bolt 400. Thus, the buffer spacer aperture 520 may be threadedly attached to the adjustment bolt 400, via interaction of the externally threaded body portion 420 of the adjustment bolt 400 and the internally threaded buffer spacer aperture 520 of the buffer spacer 500.

A capture pin recess 522 is formed in a terminal end of the adjustment bolt 500, opposite the head portion 510. The capture pin recess 522 is formed so as to accept at least a portion of the capture pin 550 within the capture pin recess 522.

When the buffer spacer 500 is appropriately, threadedly attached to the adjustment bolt 400, the attachment bolt 400 extends through the buffer spacer 500 such that the capture pin recess 522 is aligned with the capture pin recess 422 of the adjustment bolt 400. When the capture pin 550 is positioned within at least portions of the aligned capture pin recess 522 and capture pin recess 422, the attachment bolt 400 is kept from being rotated relative to the buffer spacer 500.

Thus, when the capture pin 550 is positioned within at least portions of the aligned capture pin recess 522 and capture pin recess 422, if the attachment bolt 400 rotated, the buffer spacer 500 and the capture pin 550 are also rotated together with the attachment bolt 400. The buffer spacer 500 is sized so as to be fitted within the spacer cavity 137 of the buffer element 105.

As illustrated most clearly in FIGS. 27-31, the end cap 700 comprises a portion of material extending, along a longitudinal axis $A_L$, from a first end 701 of the end cap 700 to a second end of the end cap 700. In various exemplary embodiments, an end cap extension portion 720 of the end cap 700 extends rearward from the first end 701 of the end cap 700. The end cap extension portion 720 of the end cap 700 extends from the first end 701 of the end cap 700 to an end cap shoulder 715. In various exemplary embodiments, the end cap extension portion 720 of the end cap 700 extends parallel to the longitudinal axis $A_L$, of the end cap 700 and the end cap shoulder 715 extends perpendicular to the longitudinal axis $A_L$, of the end cap 700. Alternatively, the end cap shoulder 715 may extend at an angle that is equal to, greater than, or less than 90° relative to the longitudinal axis $A_L$, of the end cap 700.

The outer size and shape of the end cap extension portion 720 of the end cap 700 is such that at least a portion of the end cap extension portion 720 of the end cap 700 can be fitted through the open end of the spacer cavity 137 and positioned within at least a portion of the spacer cavity 137.

An end cap head portion 710 extends rearward from the end cap shoulder 715 to the second end of the end cap 700. In various exemplary embodiments, the end cap head portion 710 has an overall dome or a tapered shape. Alternatively, the end cap head portion 710 may comprise a generally cylindrical overall shape.

An end cap retaining aperture 722 extends at least partially through the end cap extension portion 720 of the end cap 700 and is formed so as to accept at least a portion of a retaining pin 132 therethrough.

In various exemplary embodiments, the end cap 700 is substantially rigid and is formed of urethane. Alternatively, the end cap 700 may be substantially deformable or flexible and may be formed of rubber, silicone, plastic, self-lubricating plastic, or a polymeric material. Thus, it should be understood that the material or materials used to form the end cap 700 is a design choice based on the desired appearance and/or functionality of the end cap 700.

In various exemplary embodiments, wherein the weight element 600 is not included, end cap extension portion 720 of the end cap 700 can be sized so as to be abutted against the capture pin 550 and assist in maintaining the capture pin 550 within at least portions of the aligned capture pin recess 522 and capture pin recess 422.

As illustrated most clearly in FIGS. 1-2 and 32-45, the various components of the adjustable buffer system 100 are fitted together and can be utilized in conjunction with an exemplary buffer spring 30 within an exemplary buffer tube 20. During an exemplary method of assembly, the slidable collar 300 is positioned such that the core portion 319 is slidably fitted within at least a portion of the collar cavity 127. Each leg 315 is aligned with and slidably fitted within a respective longitudinally extending slot 130. Additionally, a prong 132 is fitted through each prong aperture 317 and such that the slidable collar 300 is repeatably slidable along the longitudinal axis of at least a portion of the buffer element 105, as defined by the interaction of the longitudinally extending slots 130 and the legs 315.

When the slidable collar 300 is fitted to the buffer element 105, the ring portion 310 extends beyond an outer surface of the buffer element 105 and the slidable collar 300 may be repeatably slidable along at least a portion of the longitudinal axis of the buffer element 105, without the slidable collar 300 rotating relative to the buffer element 105 (except as allowed by the tolerance between the longitudinally extending slots 130 and the corresponding legs 315).

The adjustment bolt 400 is threadedly attached to slidable collar 300, via interaction of the externally threaded body portion 420 of the adjustment bolt 400 and the internally threaded collar aperture 320 of the slidable collar 300. As the adjustment bolt 400 is threadedly attached to the slidable collar 300, at least a portion of the threaded body portion 420 extends through the bolt aperture 135 and into the spacer cavity 137.

The buffer spacer 500 is positioned within the spacer cavity 137 and at least a portion of the externally threaded body portion 420 of the adjustable bolt 400 is threadedly attached to the buffer spacer 500, such that the externally threaded body portion 420 extends through the buffer spacer 500 sufficient that the capture pin recess 522 is aligned with the capture pin recess 422 of the adjustment bolt 400.

When the capture pin recess 522 is appropriately aligned with the capture pin recess 422, the capture pin 550 is positioned within at least portions of the aligned capture pin recess 522 and capture pin recess 422. In this manner, the attachment bolt 400 is kept from being rotated relative to the buffer spacer 500. Thus, when the capture pin 550 is positioned within at least portions of the aligned capture pin recess 522 and capture pin recess 422, if the attachment bolt 400 rotated, the buffer spacer 500 and the capture pin 550 are also rotated together with the attachment bolt 400.

If included, the weight element 600 is inserted within the spacer cavity 137 so as to be abutted against the capture pin 550 and assist in maintaining the capture pin 550 within at least portions of the aligned capture pin recess 522 and capture pin recess 422.

At least a portion of the end cap extension portion 720 of the end cap 700 is fitted within the spacer cavity 137, such that the end cap retaining aperture 722 is aligned with the buffer element retaining pin aperture 122. In this configuration, the end cap shoulder 715 optionally contacts the second end 102 of the buffer element 105.

Once the end cap 700 is appropriately positioned proximate the second end 102 of the buffer element 105, the retaining pin 132 is positioned through the end cap retaining aperture 722 and the buffer element retaining pin aperture 122 to maintain the end cap 700 in a desired position relative to the buffer element 105. This also optionally aids in maintaining the weight element 600 in a desired position relative to the buffer spacer 500 and the capture pin 550.

The collar nut 200 is threadedly fitted about the buffer element 105, via interaction of the internally threaded portion 226 of the collar nut 200 and the externally threaded portion 126 of the buffer element 105. When the collar nut 200 is appropriately fitted about the buffer element 105, the collar screw aperture 217 is aligned with the buffer screw aperture 117 and the set screw 232 is threaded the inserted through at least portions of the collar screw aperture 217 and the buffer screw aperture 117. In this manner, the collar nut 200 may be further maintained in a desired, rotational position, relative to the buffer element 105.

In addition to maintaining the collar nut 200 and a desired position relative to the buffer element 105, the set screw 232 is threadedly inserted such that at least a portion of the detent 235 extends into the collar cavity 127 a sufficient distance to interact with and be at least partially captured within a portion of a recess 412, of the adjustment bolt 400. In this manner, the interaction between at least a portion of the detent 235 and a recess 412 maintains the adjustment bolt 400 in a desired rotational position relative to the buffer element 105.

To adjust the rotational position of the adjustable bolt 400 relative to the buffer element 105, a rotational force is applied to the head portion 410 of the adjustment bolt 400, typically via the slot 415 formed in the head portion 410. As the rotational force is applied, at least a portion of the spring biasing element 237 interacts with a side wall of the recess 412 to overcome the spring bias of the spring biasing element 237 and urge the detent 235 from the recess 412, further into the cavity of the set screw 232. This allows the adjustment bolt 400 to be rotated until the spring bias of the spring biasing element 237 urges the spring biasing element 237 into a subsequent portion of a subsequent recess 412.

As the rotational force is applied to the adjustment bolt 400, the threaded attachment of the slidable collar 300 produces longitudinal movement of the slidable collar 300 along at least a portion of the threaded body portion 420. For example, clockwise rotation of the adjustment bolt 400 may result in the slidable collar 300 being moved, longitudinally, toward the first end 101 of the buffer element 105, while counterclockwise rotation of the adjustment bolt 400 may result in the slidable collar 300 being moved, longitudinally, toward the second and 102 of the buffer element 105. It should be appreciated that the direction of longitudinal movement of the slidable collar 300 relative to rotational movement of the adjustment bolt 400 can be dictated based upon whether right-hand or left-hand threads utilized in or on the slidable collar 300 and the adjustment bolt 400.

Thus, by rotating the adjustment bolt 400 relative to the slidable collar 300, while the slidable collar 300 is kept from rotating relative to the adjustment bolt 400, the longitudinal position of the slidable collar 300 along the adjustment bolt 400 and the buffer element 105 can be adjusted by interaction of the externally threaded body portion 420 of the adjustment bolt 400 and the internally threaded collar aperture 320 of the slidable collar 300.

Once the relevant components are attached or coupled to the buffer element 105, at least a portion of the buffer element body portion 120 of the assembled adjustable buffer system 100 is positionable within the buffer spring 30 such that the first end of the buffer spring 30 engages or contacts the slidable collar 300. The assembled adjustable buffer system 100 and buffer spring 30 may then be inserted within a buffer tube 20.

Because the position of the slidable collar 300 along the buffer element 105 can be adjusted (moved up and down the shaft of the buffer element 105), the degree of compression of the buffer spring 30 can be adjusted to increase or decrease spring pressure from the buffer spring 30, as desired, to alter the recoil action of the firearm in which the adjustable buffer system 100 is installed.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An adjustable buffer system, comprising:

a buffer element, wherein said buffer element includes a collar cavity, wherein said collar cavity extends from a first end of said buffer element, along one or more collar cavity interior side walls, to a collar cavity bottom wall, wherein said buffer element includes a spacer cavity, wherein said spacer cavity extends from a second end of said buffer element, along one or more buffer cavity interior side walls, to a buffer cavity bottom wall, wherein a bolt aperture is formed between said collar cavity bottom wall and said spacer cavity bottom wall, wherein an externally threaded portion extends from said first end of said buffer element, wherein an internally threaded buffer screw aperture is formed in said buffer element, proximate said first end of said buffer element, wherein two or more longitudinally extending slots are formed in at least a portion of said buffer element, extending from said first end of said buffer element, and wherein a prong is defined between each longitudinally extending slot;

a set screw, wherein said set screw includes an internal recess that includes a captured, spring biased detent;

a collar nut, wherein said collar nut includes an internally threaded collar nut aperture formed through said collar nut, wherein said internally threaded portion includes threads that correspond to said externally threaded portion of said buffer element, such that said collar nut may be threadedly attached to said buffer element, via interaction of said externally threaded portion of said buffer element and said internally threaded portion of said collar nut, and wherein an internally threaded collar screw aperture is formed in said collar nut so as to be aligned with said internally threaded buffer screw aperture, when said collar nut is threadedly attached to said buffer element, and wherein when said internally threaded collar screw aperture is aligned with said internally threaded buffer screw aperture, said set screw may be threadedly inserted within at least a portion of said internally threaded collar screw aperture and said aligned internally threaded buffer screw aperture;

an adjustment bolt, wherein said adjustment bolt comprises a head portion and an externally threaded body portion extending from said head portion, wherein a capture pin recess is formed in a terminal end of said adjustment bolt, wherein said capture pin recess is formed so as to accept at least a portion of a capture pin within said capture pin recess, and wherein one or more recesses are formed around said outer circumference of said head portion;

a slidable collar, wherein said slidable collar includes a ring portion, wherein said ring portion surrounds a core portion, wherein said ring portion is spaced apart from said core portion by two or more legs, and wherein prong apertures are defined between said ring portion, said core portion, and said legs, wherein each of said legs corresponds to one of said longitudinally extending slots, wherein each prong aperture is formed so as to allow a portion of a prong to be fitted therethrough, such that said slidable collar is repeatably slidable along at least a portion of said buffer element, wherein an internally threaded collar aperture is formed through said core portion, wherein said internally threaded collar aperture includes threads that correspond to said externally threaded body portion of said adjustment bolt, and wherein said slidable collar may be threadedly attached to at least a portion of said adjustment bolt, via interaction of said externally threaded body portion of said adjustment bolt and said internally threaded collar aperture of said slidable collar, such that rotational movement of said adjustment bolt relative to said buffer element produces longitudinal movement of said slidable collar along said buffer element;

a buffer spacer, wherein said buffer spacer includes an internally threaded buffer spacer aperture formed through said buffer spacer, wherein said internally threaded buffer spacer aperture includes threads that correspond to said externally threaded body portion of said adjustment bolt, such that said buffer spacer may be threadedly attached to said adjustment bolt, via interaction of said externally threaded body portion of said adjustment bolt and said internally threaded buffer spacer aperture of said buffer spacer, wherein a capture pin recess is formed in a terminal end of said adjustment bolt, and wherein said capture pin recess is formed so as to accept at least a portion of said capture pin within said capture pin recess; and an end cap, wherein an extension portion of said end cap may be abutted against said capture pin to assist in maintaining said capture pin within at least portions of said capture pin recess of said buffer spacer and said capture pin recess of said adjustment bolt.

2. The adjustable buffer system of claim 1, wherein said buffer screw aperture is formed through said buffer element within a portion of said externally threaded portion of said buffer element.

3. The adjustable buffer system of claim 1, wherein a spring or other spring biasing element, within said internal recess of said set screw, supplies a spring biasing force to said detent.

4. The adjustable buffer system of claim 1, wherein said longitudinally extending slots extend from said first end of said buffer element to said collar cavity bottom wall.

5. The adjustable buffer system of claim 1, wherein said two or more longitudinally extending slots comprise three or more longitudinally extending slots formed in at least a portion of said buffer element, extending from said first end of said buffer element, wherein a prong is defined between each longitudinally extending slot.

6. The adjustable buffer system of claim 1, further comprising one or more notches formed around portions of said collar nut.

7. The adjustable buffer system of claim 1, further comprising a series of recesses formed around said outer circumference of said head portion.

8. The adjustable buffer system of claim 1, further comprising a slot formed in said head portion, wherein said slot allows rotational force to be applied to said adjustment bolt.

9. The adjustable buffer system of claim 1, wherein said core portion may be slidably fitted within at least a portion of said collar cavity, with each leg being slidably fitted within one of said longitudinally extending slots.

10. The adjustable buffer system of claim 1, wherein said legs are formed so as to be aligned with and slidable along said longitudinally extending slots of said buffer element, such that interaction of said legs and said longitudinally extending slots maintains said slidable collar in a substantially consistent rotational position relative to said buffer element.

11. The adjustable buffer system of claim 1, wherein one or more notches are formed around portions of said slidable collar.

12. The adjustable buffer system of claim 1, wherein when said buffer spacer is threadedly attached to said adjustment bolt, said attachment bolt extends through said buffer spacer such that said capture pin recess of said buffer spacer is aligned with said capture pin recess of said adjustment bolt and said capture pin is positioned within at least portions of said aligned capture pin recess of said buffer spacer and said capture pin recess of said adjustment bolt such that said attachment bolt is maintained in a fixed, rotational position relative to said buffer spacer.

13. The adjustable buffer system of claim 1, wherein when said set screw is threadedly inserted within at least a portion of said internally threaded collar screw aperture and said aligned internally threaded buffer screw aperture, at least a portion of said detent extends into said collar cavity a sufficient distance to interact with and be at least partially captured within a portion of a recess of said adjustment bolt.

14. An adjustable buffer system, comprising:

a buffer element, wherein said buffer element includes a collar cavity, wherein said collar cavity extends from a first end of said buffer element, along one or more collar cavity interior side walls, to a collar cavity bottom wall, wherein said buffer element includes a spacer cavity, wherein said spacer cavity extends from a second end of said buffer element, along one or more buffer cavity interior side walls, to a buffer cavity bottom wall, wherein a bolt aperture is formed between said collar cavity bottom wall and said spacer cavity bottom wall, wherein an externally threaded portion extends from said first end of said buffer element, wherein an internally threaded buffer screw aperture is formed in said buffer element, proximate said first end of said buffer element, wherein two or more longitudinally extending slots are formed in at least a portion of said buffer element, extending from said first end of said buffer element, and wherein a prong is defined between each longitudinally extending slot;

a set screw, wherein said set screw includes an internal recess that includes a captured, spring biased detent;

a collar nut, wherein said collar nut includes an internally threaded collar nut aperture formed through said collar nut, wherein said internally threaded portion includes threads that correspond to said externally threaded portion of said buffer element, such that said collar nut may be threadedly attached to said buffer element, via interaction of said externally threaded portion of said buffer element and said internally threaded portion of said collar nut, and wherein an internally threaded collar screw aperture is formed in said collar nut so as to be aligned with said internally threaded buffer screw aperture, when said collar nut is threadedly attached to said buffer element, and wherein when said internally threaded collar screw aperture is aligned with said internally threaded buffer screw aperture, said set screw may be threadedly inserted within at least a portion of said internally threaded collar screw aperture and said aligned internally threaded buffer screw aperture;

an adjustment bolt, wherein said adjustment bolt comprises a head portion and an externally threaded body portion extending from said head portion, wherein a capture pin recess is formed in a terminal end of said adjustment bolt, wherein said capture pin recess is formed so as to accept at least a portion of a capture pin within said capture pin recess, and wherein one or more recesses are formed around said outer circumference of said head portion;

a slidable collar, wherein said slidable collar includes a ring portion, wherein said ring portion surrounds a core portion, wherein said ring portion is spaced apart from said core portion by two or more legs, and wherein prong apertures are defined between said ring portion, said core portion, and said legs, wherein each of said legs corresponds to one of said longitudinally extending slots, wherein each prong aperture is formed so as to allow a portion of a prong to be fitted therethrough, such that said slidable collar is repeatably slidable along at least a portion of said buffer element, wherein an internally threaded collar aperture is formed through said core portion, wherein said internally threaded collar aperture includes threads that correspond to said externally threaded body portion of said adjustment bolt, and wherein said slidable collar may be threadedly attached to at least a portion of said adjustment bolt, via interaction of said externally threaded body portion of said adjustment bolt and said internally threaded collar aperture of said slidable collar, such that rotational movement of said adjustment bolt relative to said buffer element produces longitudinal movement of said slidable collar along said buffer element;

a buffer spacer, wherein said buffer spacer includes an internally threaded buffer spacer aperture formed through said buffer spacer, wherein said internally threaded buffer spacer aperture includes threads that correspond to said externally threaded body portion of said adjustment bolt, such that said buffer spacer may be threadedly attached to said adjustment bolt, via interaction of said externally threaded body portion of said adjustment bolt and said internally threaded buffer spacer aperture of said buffer spacer, wherein a capture pin recess is formed in a terminal end of said adjustment bolt, and wherein said capture pin recess is formed so as to accept at least a portion of said capture pin within said capture pin recess;

a weight element, wherein said weight element is sized so as to be fitted within at least a portion of said spacer cavity of said buffer element, and wherein said weight element may be abutted against said capture pin to assist in maintaining said capture pin within at least portions of said capture pin recess of said buffer spacer and said capture pin recess of said adjustment bolt; and an end cap, wherein an extension portion of said end cap may be abutted against said weight element to assist in maintaining said weight element within said spacer cavity.

15. The adjustable buffer system of claim 14, wherein said buffer screw aperture is formed through said buffer element within a portion of said externally threaded portion of said buffer element.

16. The adjustable buffer system of claim 14, wherein a spring or other spring biasing element, within said internal recess of said set screw, supplies a spring biasing force to said detent.

17. The adjustable buffer system of claim 14, wherein said longitudinally extending slots extend from said first end of said buffer element to said collar cavity bottom wall.

18. The adjustable buffer system of claim 14, wherein said two or more longitudinally extending slots comprise three or more longitudinally extending slots formed in at least a portion of said buffer element, extending from said first end of said buffer element, wherein a prong is defined between each longitudinally.

19. An adjustable buffer system, comprising:

a buffer element, wherein said buffer element includes a collar cavity and a spacer cavity, wherein a bolt aperture is formed between said collar cavity and said spacer cavity, wherein an externally threaded portion extends from said first end of said buffer element, wherein two or more longitudinally extending slots are formed in at least a portion of said buffer element, extending from said first end of said buffer element, and wherein a prong is defined between each longitudinally extending slot;

an adjustment bolt, wherein said adjustment bolt comprises a head portion and an externally threaded body portion extending from said head portion, wherein a capture pin recess is formed in a terminal end of said adjustment bolt, wherein said capture pin recess is formed so as to accept at least a portion of a capture pin within said capture pin recess, and wherein one or more recesses are formed around said outer circumference of said head portion;

a slidable collar, wherein said slidable collar includes a ring portion surrounding a core portion, wherein said ring portion is spaced apart from said core portion by two or more legs, and wherein prong apertures are defined between said ring portion, said core portion, and said legs, wherein each of said legs corresponds to one of said longitudinally extending slots, wherein each prong aperture is formed so as to allow a portion of a prong to be fitted therethrough, such that said slidable collar is repeatably slidable along at least a portion of said buffer element, wherein an internally threaded collar aperture is formed through said core portion, wherein said internally threaded collar aperture includes threads that correspond to said externally threaded body portion of said adjustment bolt, and wherein said slidable collar may be threadedly attached to at least a portion of said adjustment bolt, via interaction of said externally threaded body portion of said adjustment bolt and said internally threaded collar aperture of said slidable collar, such that rotational movement of said adjustment bolt relative to said buffer element produces longitudinal movement of said slidable collar along said buffer element; and a buffer spacer, wherein said buffer spacer includes an internally threaded buffer spacer aperture formed through said buffer spacer, wherein said internally threaded buffer spacer aperture includes threads that correspond to said externally threaded body portion of said adjustment bolt, such that said buffer spacer may be threadedly attached to said adjustment bolt, via interaction of said externally threaded body portion of said adjustment bolt and said internally threaded buffer spacer aperture of said buffer spacer, wherein a capture pin recess is formed in a terminal end of said adjustment bolt, and wherein said capture pin recess is formed so as to accept at least a portion of said capture pin within said capture pin recess.

20. The adjustable buffer system of claim 19, further comprising an end cap, wherein a portion of said end cap may be abutted against a weight element to assist in maintaining said weight element within said spacer cavity.

* * * * *